US009775770B2

(12) United States Patent
Eastman et al.

(10) Patent No.: US 9,775,770 B2
(45) Date of Patent: Oct. 3, 2017

(54) DEVICE FOR APPLYING STIMULATION TO THE FOOT OR FEET OF A PERSON

(71) Applicant: VITAL MOTION INC., Pittsford, NY (US)

(72) Inventors: Jay M. Eastman, Pittsford, NY (US); Zachary M. Eastman, Pittsford, NY (US); Scott R. Grodevant, Avon, NY (US)

(73) Assignee: VITAL MOTION INC., Cornelius, NC (US)

( * ) Notice: Subject to any disclaimer, the term of this patent is extended or adjusted under 35 U.S.C. 154(b) by 0 days.

(21) Appl. No.: 14/543,494

(22) Filed: Nov. 17, 2014

(65) Prior Publication Data

US 2016/0206501 A1 Jul. 21, 2016

(51) Int. Cl.

| | |
|---|---|
| ***A61H 23/02*** | (2006.01) |
| ***A61H 1/00*** | (2006.01) |
| ***A61H 1/02*** | (2006.01) |

(52) U.S. Cl.

CPC ..... *A61H 23/02* (2013.01); *A61H 1/005* (2013.01); *A61H 1/0266* (2013.01); *A61H 2201/164* (2013.01); *A61H 2201/5012* (2013.01); *A61H 2201/5015* (2013.01); *A61H 2201/5043* (2013.01); *A61H 2201/5084* (2013.01); *A61H 2201/5097* (2013.01); *A61H 2205/12* (2013.01)

(58) Field of Classification Search

CPC ..... A61H 1/005; A61H 1/0266; A61H 23/02–2023/029; A61H 2201/164; A61H 2205/12

See application file for complete search history.

(56) References Cited

U.S. PATENT DOCUMENTS 2,235,158 A * 3/1941 Krenzke ..... A61H 1/005 310/81
2,566,484 A * 9/1951 Coury ..... A61H 1/005 601/65
3,043,294 A * 7/1962 Neff ..... A61H 1/005 601/27

(Continued)

OTHER PUBLICATIONS

Regenerative Technologies Corporation, Juvent's Micro-Impact Platform, Sep. 12, 2014, p. 1-4, http://www.juventhealth.com.

(Continued)

*Primary Examiner* — Valerie L Woodward
(74) *Attorney, Agent, or Firm* — Lukacher Law Group; Kenneth J. Lukacher

(57) ABSTRACT

A device for stimulating the Meissner's Corpuscles along the front plantar portion of the foot or feet of a person is provided. The device has a platform disposed upon motion guides for movement up and down with respect to a base. The platform has a shaped surface for ease of placement of at least the front plantar portion of at least one foot of a person seated in front of the device in which the back or heel portion of the foot is disposed away from the device. One or more inertial actuators are attached to the platform underneath its surface. A controller controls operation of the actuator(s), via signals to a driver, to move the platform with respect to the base in a sinusoidally varying motion at a user selectable stimulation level. The stimulation level may be set wirelessly via an external device, or by manually tilting the device.

27 Claims, 12 Drawing Sheets

(56) References Cited

U.S. PATENT DOCUMENTS 3,304,935 A 2/1967 Kennedy et al.
3,762,402 A * 10/1973 Abramovitz ..... A61H 23/0263 5/109
3,830,232 A 8/1974 McNair
D234,828 S 4/1975 McNair
4,105,024 A * 8/1978 Raffel ..... A61H 9/0078 5/674
D269,636 S 7/1983 MacGregor et al.
4,513,735 A 4/1985 Friedson et al.
D280,934 S 10/1985 MacGregor
4,967,736 A * 11/1990 Spitzer ..... A61H 1/005 601/35
5,099,826 A * 3/1992 Hayakawa ..... A61H 23/0254 310/40 R
5,103,806 A 4/1992 McLeod et al.
D330,256 S 10/1992 Wollman
5,191,880 A 3/1993 McLeod et al.
5,273,028 A * 12/1993 McLeod ..... A61F 2/28 601/35
D351,027 S 9/1994 Chen
5,376,065 A 12/1994 McLeod et al.
D363,556 S 10/1995 Katsunuma et al.
D371,850 S 7/1996 Ediger et al.
5,573,500 A 11/1996 Katsunuma et al.
5,681,266 A 10/1997 Lin
D387,175 S 12/1997 Chen
5,813,958 A * 9/1998 Tomita ..... A61H 1/0266 482/146
5,827,205 A 10/1998 Iwamoto
5,868,688 A 2/1999 Avidor
D408,926 S 4/1999 Hashimoto
5,997,490 A 12/1999 McLeod et al.
D419,683 S 1/2000 Miyake
6,022,349 A 2/2000 McLeod et al.
D435,111 S 12/2000 Kuo
D435,299 S 12/2000 Chou
D443,064 S 5/2001 Persson
6,607,497 B2 8/2003 McLeod et al.
D496,468 S 9/2004 Park
6,843,776 B2 1/2005 Trandafir et al.
6,884,227 B2 4/2005 Krompasick
7,094,211 B2 8/2006 Krompasick
7,166,067 B2 1/2007 Talish et al.
7,207,954 B2 4/2007 Trandafir et al.
7,207,955 B2 4/2007 Krompasick
7,322,948 B2 1/2008 Talish et al.
D564,734 S 3/2008 Krompasick et al.
7,338,457 B2 3/2008 Talish et al.
7,402,144 B2 * 7/2008 McLeod ..... A61H 1/001 601/27
D628,303 S 11/2010 Hsu
7,942,835 B2 5/2011 Talish et al.
8,043,234 B2 10/2011 Talish et al.
8,491,509 B2 7/2013 Trandafir
8,603,017 B2 12/2013 Trandafir et al.
8,795,210 B2 8/2014 Talish et al.
8,801,576 B1 * 8/2014 Shin ..... A63B 21/0053 482/1
9,351,897 B1 * 5/2016 Woggon ..... A61H 1/005
2005/0124468 A1 6/2005 Wong
2006/0030799 A1 2/2006 Adkins et al.
2006/0111652 A1 5/2006 McLeod
2006/0200054 A1 9/2006 Talish et al.
2007/0043310 A1 2/2007 Trandafir et al.
2007/0055185 A1 3/2007 Trandafir et al.
2007/0078361 A1 * 4/2007 Wong ..... A61H 39/04 601/29
2007/0213179 A1 9/2007 Trandafir
2007/0249974 A1 * 10/2007 Kim ..... A61H 1/005 601/48
2007/0299372 A1 12/2007 Chang
2008/0009776 A1 1/2008 Trandafir
2008/0015476 A1 1/2008 Talish et al.
2008/0036303 A1 * 2/2008 Stevens ..... A61H 1/005 310/12.04
2008/0125679 A1 * 5/2008 Ezenwa ..... A61H 1/005 601/49
2008/0139977 A1 6/2008 Talish et al.
2008/0139979 A1 6/2008 Talish et al.
2008/0167563 A1 7/2008 Trandafir
2008/0179976 A1 * 7/2008 Wu ..... A61H 1/005 310/80
2008/0275373 A1 * 11/2008 van der Meer ..... A61H 1/005 601/49
2010/0152819 A1 6/2010 McLeod
2010/0179459 A1 * 7/2010 Koch ..... A61H 1/005 601/53
2011/0018390 A1 1/2011 Guidarelli et al.
2011/0124473 A1 5/2011 Kole et al.
2013/0079690 A1 * 3/2013 Chen ..... A61H 1/005 601/134
2013/0331745 A1 * 12/2013 Sedic ..... A61H 19/34 601/46
2014/0213940 A1 7/2014 Mayer

OTHER PUBLICATIONS

Regenerative Technologies Corporation, Juvent 1000N Micro-Impact Platform, Sep. 12, 2014, p. 1-3, http://www.juventhealth.com/products/juvent-1000n/.
Dayton Audio TT25-8 PUCK Tactile Transducer Mini Bass Shaker 8 Ohm, Sep. 15, 2014. p. 1-7, http://www.parts-express.com/dayton-audio-tt25-8-puck-tactile-transducer-mini-bass-shaker-8-ohm--300-386.
Dayton Audio, Tech Note: Understanding Exciters—Principles and Applications, 2014, p. 1-8.
J. M. Stewart et al., Plantar Vibration Improves Leg Fluid Flow in Perimenopausal Women, American Journal of Physiology-Regulatory, Integrative and Comparative Physiology, Mar. 2005, p. R623-R629, vol. 288.
G. Madhavan et al., Enhancing Hemodialysis Efficacy through Neuromuscular Stimulation, Blood Purification, Jan. 2009, p. 58-63, vol. 27.
C. Pierce et al., Feasibility of Treatment of Lower Limb Edema with Calf Muscle Pump Stimulation in Chronic Heart Failure, European Journal of Cardiovascular Nursing, Jul. 2009, p. 1-4.
C. Pierce et al., Influence of Seated Rocking on Blood Pressure in the Elderly: A Pilot Clinical Study, Biological Research for Nursing, Oct. 2009, p. 144-151, vol. 11.
G. Madhavan et al., Prevalence and Etiology of Delayed Orthostatic Hypotension in Adult Women, Archives of Physical Medicine and Rehabilitation, Sep. 2008, p. 1788-1794, vol. 89.
A. A. Goddard et al., Reversal of Lower Limb Edema by Calf Muscle Pump Stimulation, Journal of Cardiopulmonary Rehabilitation and Prevention, 2008, p. 174-179, vol. 28.
G. Madhavan et al., Effect of Plantar Micromechanical Stimulation on Cardiovascular Responses to Immobility, American Journal of Physical Medicine and Rehabilitation, May 2005, p. 338-345, vol. 84, No. 5.
Printout from Vital Motion, Inc., website http://vitalmotion.com/Products/SMS_100.html at least as early as Nov. 16, 2013.

* cited by examiner

DEVICE FOR APPLYING STIMULATION TO THE FOOT OR FEET OF A PERSON

FIELD OF THE INVENTION

The present invention relates to a device (and method) for applying stimulation to the foot or feet of a person, and particularly to a device for applying stimulation in the form of vibration to the front plantar surface of the foot or feet of a person. The present invention is useful for stimulation of the Meissner's Corpuscles along the front plantar portion(s) of a person's foot or feet presented upon the device when the person is in a seated position in front of the device, and the heel(s) of the foot or feet are positioned away from the device. Such stimulation is intended to provide therapeutic effects enhancing the health of the person.

BACKGROUND OF THE INVENTION

Devices have been developed that stimulate the bottom of a person's foot. The stimulation by such devices is intended to provide therapeutic effects, such as for bone growth, treating orthostatic hypotension, postural instability, enhanced blood and lymph flow, or deep vein thrombosis. Such devices utilize a vibrating or oscillating platform or plate that is stood upon or otherwise applied along the entire length of the bottom of the foot, and are described for example, in U.S. Pat. Nos. 5,273,028, 5,376,065, 6,607,497, 6,843,776, 6,884,227, 7,402,144, 7,207,954, 7,207,955, and 8,603,017, and U.S. Patent Publication Nos. 2007/0055185, 2007/0213179, 2007/0043310, 2008/0015476, and 2008/0139979. Devices for vibrating or oscillating each foot have also been designed into exercise equipment, such as a step climbing machine or stationary bicycle, as described in U.S. Pat. Nos. 7,166,067, 7,322,948, and 7,338,457, or in footwear, as described in U.S. Pat. No. 8,795,210.

A vibration platform, the Juvent 1000N Micro-Impact Platform, is a product of Regenerative Technologies Corporation of Riviera Beach, Fla., USA, having a base with an oscillating actuator for pivoting up and down a lever at a first frequency which is linked by a dampening spring to pivot two primary levers at a second frequency, and such primary levers have linkages for pivoting two secondary levers. The ends of each of the primary and secondary levers pivot an upper plate that free-floats upon the base. A controller operates the oscillating actuator to provide the desired vibration to the upper plate when stood upon by a person. The design of the 1000N Micro-Impact Platform is believed to be described in one or more of U.S. Pat. Nos. 6,843,776, 6,884,227, 7,094,211, 7,207,954 and 7,207,955, and U.S. Patent Publication Nos. 2007/0055185, 2007/0213179, and 2007/0043310. Although the 1000N Micro-Impact Platform is useful, it is heavy at 20 lbs., and bulky as it requires complex levers and linkages to impart up and down motion to the upper plate designed to be stood upon with both feet by a person. Accordingly, it would be desirable to provide a compact device which stimulates the bottom of the foot which avoids levers and motion transfer linkages.

It has been found that stimulation directed to the Meissner's Corpuscles in the front plantar surface of the foot can more effectively provide therapeutic effects than application of stimulation by applied up and down motion to the entire foot or the whole body as in prior art devices. Thus, a device would further be desirable that can direct stimulation primarily to the Meissner's Corpuscles located in only the front plantar portion of the foot, and thus can be more compact and portable than typical platforms that are stood upon for stimulating the entire bottom of the foot or feet. Although units have been designed for stimulating a portion of the foot, these units are strapped or fastened to the foot (see, e.g., FIG. 8 of U.S. Pat. No. 7,402,144), which is undesirable for ease of use and application to one's foot.

SUMMARY OF THE INVENTION

Accordingly, it is a principal object of the present invention to provide an improved device for applying stimulation to the foot or feet of a person which can provide such stimulation in the form of up and down motion to the front plantar portion of such foot or feet for stimulating the Meissner Corpuscles there along.

It is another object of the present invention to provide an improved device for applying stimulation to the foot or feet of a person having a platform shaped to facilitate application of up and down motion to the front plantar portion of the foot or feet when such person is in a seated position in front of the device.

A further object of the present invention is to provide an improved device for applying stimulation to the foot or feet of a person in which the person can set a desired stimulation level by either tilting the device until the platform of the device changes to the desired stimulation level, or via an external wireless remote device.

A still further object of the present invention is to provide an improved device for applying stimulation to the foot or feet of a user which automatically increases or decreases power to actuators imparting up and down motion to a platform of the device when load upon such platform increases or decreases, respectively, to maintain stimulation at or near a desired stimulation level.

Briefly described, the present invention embodies a device for applying stimulation to the foot or feet having a platform with an upper surface for placement of a bottom portion of foot or feet of a person or user, one or more actuators attached to the platform under the upper surface for imparting motion to the platform, a base disposed below the platform for supporting the device on an external surface, and motion guides coupling the platform to the base upon which the platform moves in positive and negative displacement (e.g., up and down) with respect to the base responsive to operation of the actuators.

The upper surface of the platform is shaped or contoured for ease of placement of at least the front plantar portion of at least one foot of a person seated in front of the device in which the back or heel portion of the foot is disposed away from the device. In the preferred embodiment, the upper surface of the platform is preferably sloped at an upward angle to provide a sloped portion for supporting the front plantar portion(s) of the foot or feet in which the back or heel portion(s) of the foot or feet of the user extends away from the device. Such sloped portion of the platform may be slightly inwardly curved. The upper surface of the platform preferably extends from the sloped portion along the front of the device to a level portion along the back of the device.

With the device positioned on the external surface, such as a floor, in front of a seated user with the front of the device facing the user's feet, application of the front plantar portion (s) of the foot or feet along the sloped portion provides a first mode for placement of foot or feet to receive stimulation via the platform. In a second mode, the device is positioned on the external surface in front of a seated user with back of device facing the user's feet, then the front plantar portion(s) of the foot or feet are applied upon the level portion to receive stimulation via the platform and a back or heel portion(s) of the foot or feet of the user extends away from the device at a raised height at or near the height of the level portion above the external surface, such as in the case of the user being a person wearing high heel shoes. The device may be used with one foot or both feet at the same time with or without worn foot apparel, such as shoes, sandals, or flip-flops, sock, stockings, or the like. However, if high heels are worn which would made placement at the sloped portion of the platform's upper surface uncomfortable or difficult, the second mode described upon is provided.

Unlike the prior art vibration platforms for stimulation along the entire bottom of the foot or feet, the device of the present invention is designed for directing stimulation towards the Meissner's Corpuscles along the front portion(s) of the foot or feet of a user. Stimulating the entire bottom of the foot is ineffective in providing the sought after therapeutic effect as it undesirably stimulates at the same time the Meissner's Corpuscles along both the front and back portions of the foot or feet. The present invention has a platform which is angled and sized to avoid such stimulation at the same time of both front and back portion(s) of the foot or feet, since the back or heel portion(s) of the foot or feet are not present upon the device when front portion(s) of the foot or feet are upon the device. This results in the back or heel portion(s) of the foot or feet not receiving the same stimulation as the front portion(s) of the foot or feet.

There are preferably four motion guides in the device spaced apart from each other for supporting the platform over the base. Each motion guide has a guide member with an upper flange portion fixed to the platform and a downwardly extending portion that extends through an opening in the base, a first flexible joint member disposed along the extending portion between the upper flange and the base, a retainer member which retains the end of the extending portion that extends through such opening, and a second flexible joint member between the retainer member and the base. The guide member of each motion guide moves with positive and negative displacement (e.g., up and down) in the opening along the first flexible joint member responsive to operation of the actuators, where the second flexible joint member provides an upward force on the guide member to prevent noise during actuation of the motion guide. The first and second joint members may be, for example, disc spring washers, commonly known as wave washers.

The actuators are preferably two in number, and are each an inertial actuator, such as a puck tactile transducer. However, other motion imparting device(s) or oscillator(s) fixable to a member, such as platform, may also be used. Also the device may operate with a single actuator to impart desired motion to the platform.

A controller, such as a programmed microcontroller or microprocessor, is provided on a circuit board mounted to the platform under its upper surface, and thus moves along with the platform when motion is applied thereto by the actuators. A driver on the circuit board is provided for driving the one or more actuators to impart motion to the platform, responsive to pulse width modulated signals and current (+/−) output direction signals received from the controller, with a sinusoidally varying drive current signal. Such drive current signal causes the actuators to impart motion with a sinusoidally varying amplitude such as up to ±50 microns in displacement at a desired frequency, such as 10-75 Hz, but preferably 45 Hz corresponding to a desirable frequency for stimulating Meissner's Corpuscles. The controller also controls the power applied by the driver to the one or more actuators at the sinusoidally varying amplitude by adjusting the setting of an applied reference voltage to the driver which controls the peak current of the drive current signal applied by the driver to the actuators.

An accelerometer is also mounted to the circuit board, and provides acceleration data along x, y, and z orthogonal axes to the controller. The controller uses the acceleration data to adjust the power applied by the driver to the one or more actuators so that the stimulation level is at or approximately near a stimulation level selectable by the user (or a default stimulation level if not selected). The controller may also use the accelerometer data to determine when the user has tilted the device indicating an increase or decrease in the amplitude of varying motion (e.g., + peak to − peak displacement) of the platform until arriving at a desired stimulation level. Further, the accelerometer can provide a tap signal to the controller indicating that the device has been tapped. The controller operates responsive to the tap signal to toggle on or off signals to the driver to start or stop stimulation of the one or more actuators attached to the platform.

The controller may also be in wireless communication with an external device via a wireless transceiver and antenna on the circuit board. The external device can control operation of the device, including at least the user selected stimulation level (e.g., in terms of total travel distance of + peak to − peak displacement), and turning stimulation of the device on and off. Also the controller may similarly communicate via a USB connector if optionally provided on the circuit board.

The present invention also embodies a method for controlling stimulation of a member, such as the above-described platform, which moves in positive and negative displacement responsive to at least one actuator or oscillator coupled to such member for supplying such motion. The method having the steps of generating pulse width modulated signals to a driver for applying a signal to at least one actuator to move the member with a periodically varying motion in positive and negative displacement, determining a value representative of the amplitude of actual (or real-time) periodically varying motion of the member, adjusting power of the signal applied by the driver to the actuator when such value is different from a target level by more than a desired tolerance value to move the actual amplitude of motion in a direction toward the target level, and repeating the determining and adjusting steps while the generating step is being carried out. Amplitude represents the maximum extent of vibration or oscillation of the member due to its periodically varying motion. The value representative of amplitude of motion may be in terms of difference of maximum and minimum magnitude of acceleration of the member as its motion periodically varies along x, y, and/or z orthogonal axes, where value of target level is in such same terms to facilitate comparison of amplitude and target level during the adjusting step. Such target level is selectable by the user to provide the desired level of stimulation. The method may be carried out by the controller of the device described above.

BRIEF DESCRIPTION OF THE DRAWINGS

The foregoing objects, features and advantages of the invention will become more apparent from a reading of the following description in connection with the accompanying drawings, in which.

DETAILED DESCRIPTION OF INVENTION

Figure 1:
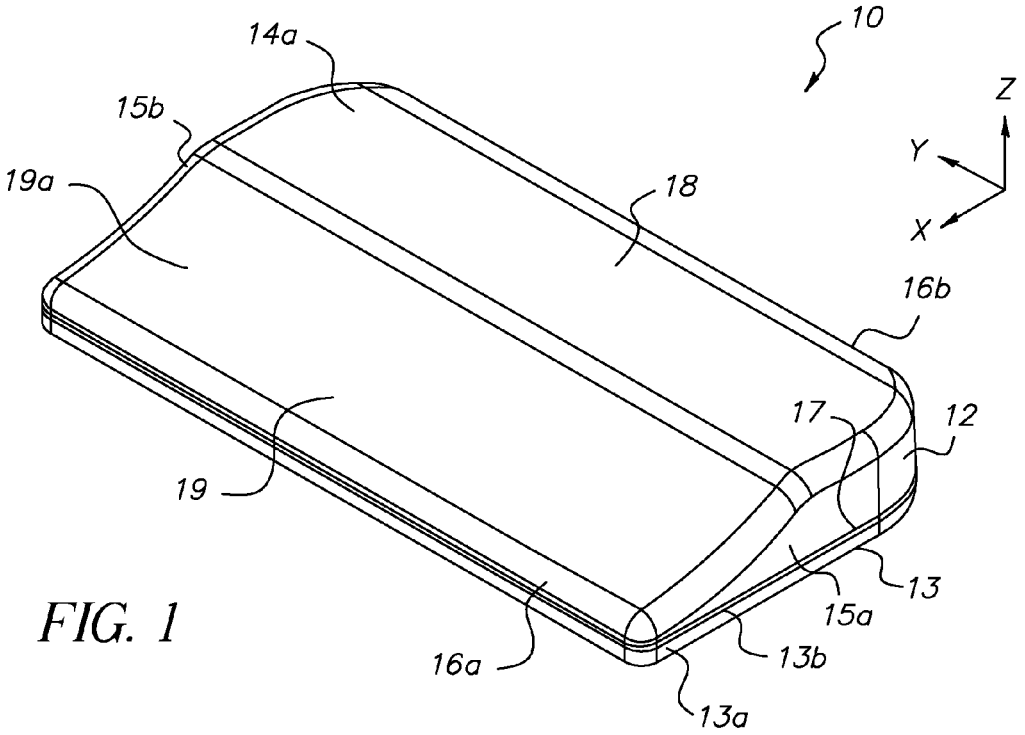
FIG. 1 is a perspective view of the stimulation device of the present application of FIG. 1.
Figure 2:
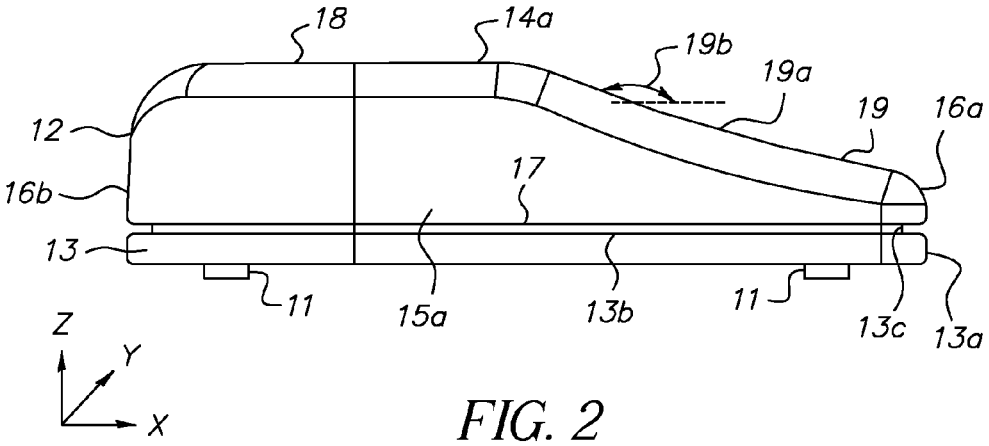
FIG. 2 is a side view of the stimulation device of the present application of FIG. 1.
Figure 3:
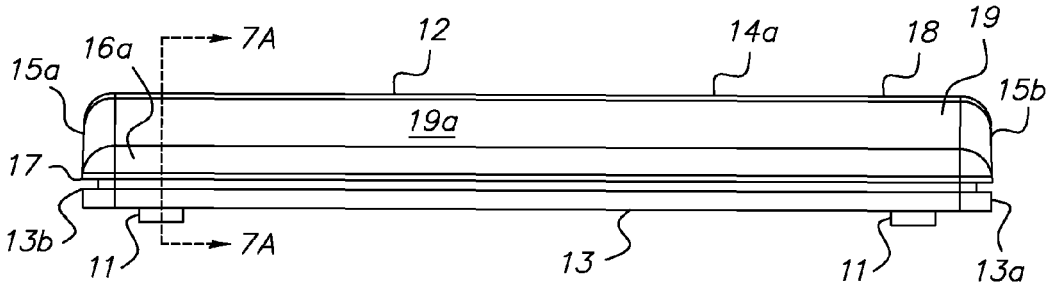
FIG. 3 is a front view of the stimulation device of the present application of FIG. 1.

Referring to FIGS. 1, 2, and 3, a device 10 is shown for providing stimulation to the front plantar portion of one or more feet of a person. The device 10 is generally rectangular in shape having a platform 12 disposed over a base 13. Platform 12 is of molded or stamped rigid plastic or metal material or other materials, and has a top surface 14*a*, right side wall 15*a*, left side wall 15*b*, front wall 16*a*, and a back wall 16*b*. Base 13 is generally a plate of molded rigid material, such as plastic, metal, or wood, or other materials, having an outer side wall 13*a* shaped to follow the exterior contour of walls 15*a*, 15*b*, 16*a*, and 16*b*. Walls 15*a*, 15*b*, 16*a*, and 16*b* downwardly extend to a continuous lower edge 17 which is spaced a vertical distance from top outer edge 13*b* of base 13. This vertical distance may be, for example, at or between 5 mm to 10 mm along the periphery of device 10. Vertical walls 15*a*, 15*b*, 16*a*, and 16*b* are preferably rounded where they meet top surface 14*a*. The width, length, and height of the device 10 extends along three orthogonal axis x, y, z, as shown in FIGS. 1 and 2.

Figure 7A:
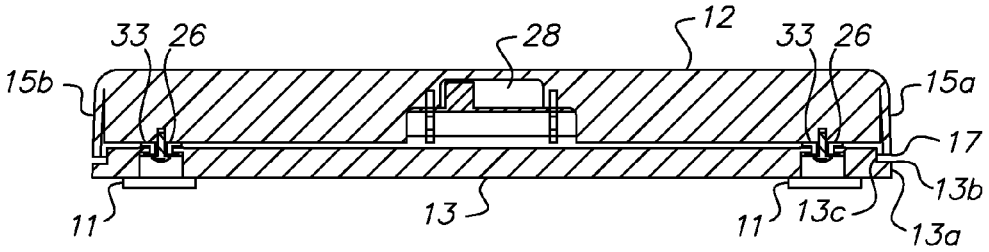
FIG. 7A is a cross-section view of the device of FIG. 1 taken along lines 7A-7A of FIG. 3.

As shown in FIG. 7A, the lower edge 17 of platform 12 extend partially over a step 13*c* of base 13 to level at edge 13*b* Although not viewable in FIGS. 1-3, platform 12 is supported over base 13 upon four motion guides 26 (FIGS. 7A, 7B, and 8) which will be described later in more detail along which platform 12 can be moved up or down in positive or negative displacement so as to move or vibrate with respect to base 13. Extending downward from base 13 are four pads 11 (see, e.g., FIGS. 2, 3, and 9), such as of rubber or other elastomeric material, for supporting the device 10 flat upon a surface.

The top surface 14*a* of platform 12 is divided into a level portion 18, and a sloped portion 19 having a surface 19*a*. The sloped portion 19 extends at an upward slope angle 19*b* with respect to the x axis, thereby continuously increasing the height of the platform 12 to level portion 18 from its lowest height along its front edge as shown in FIGS. 1 and 2. Slope angle 19*b* increases as surface 19*a* extends upwards from such front edge of the platform so that surface 19*a* is slightly inwardly (concave) curved in shape along the y axis, as best shown in FIG. 2. For example, the slope angle 19*b* smoothly varies from 10 degrees to 20 degrees as it extends upward to form the curvature along sloped portion 19. Although such curvature is preferred, other curvatures, or an upward angle with no curvature may optionally be provided, so long surface 19*a* is oriented for ease of user placement of foot or feet thereupon as described below.

The distance of sloped portion 19 between front wall 16*a* and level portion 18 along the device's width is selected to be at least the length of the front plantar portion along the typical foot, but less than the length of the entire foot. For example, such distance may be about half the width of the device 10, such as between 3 to 4.5 inches, but other distances may be selected. For example, the distance may be selected to be half of the average women's foot length, e.g., 4 inches, but a larger distance may be selected to also accommodate the front plantar portion or region of a man's larger foot upon sloped portion 19. The distance between the back wall 16*b* and the sloped portion 19 along the device's width is similarly selected to be at least the length of the front plantar portion along the typical foot, but less than the length of the entire foot. The length of the device 10 allows the user, if desired, to place both feet comfortably spaced beside each other upon either slope portion 18 or level portion 19, as described below.

Figure 4A:
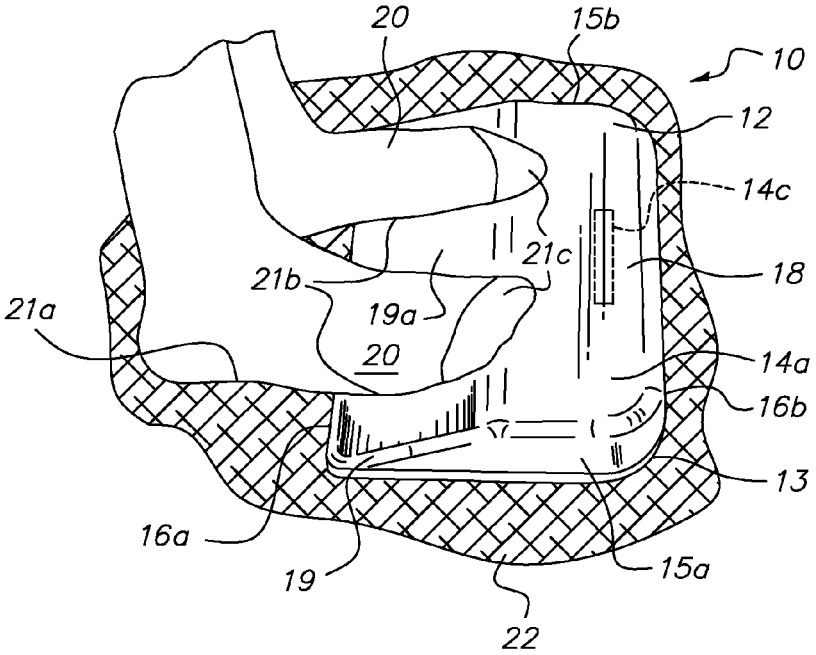
FIG. 4A is an example of front mode usage of on stimulation device of FIG. 1.

As illustrated for example in FIG. 4A, device 10 is disposed on an external surface 22 upon pads 11 (not viewable). Typically the foot 20 of a user extends with respect to platform 12 so that the back or heel portion 21*a* of foot 20 is positioned on or over external surface 22 off or extending away from device 10, and the front plantar portion 21*b* of the foot 20 extends upwards upon sloped portion 19 of surface 14*a*. The toes 21*c* of the foot 20 may lie near or extend over onto level portion 18 depending on the length of the foot 20. The curvature along surface 19*a* of slope portion 19 allows the foot 20 to compress or conform slightly along surface 19*a* to promote contact between surface 14*a* where bottom of foot 20 faces sloped portion 19. The example of FIG. 4A represents a first or front mode of operating device 10 with placement of the front plantar portion 21*b* of the foot 20 upon platform 12. It is often desirable that the front plantar portion 21*b* of both feet 20 of the user are on the platform 12 at the same time as shown in FIG. 4A, rather than the front plantar portion 21*b* of a single foot. Although shown wearing socks in FIG. 4A, the foot 20 may be placed upon device 10 with or without foot apparel (e.g., shoes, sandals, or flip-flops, socks, stockings, or the like). Shoes or other foot apparel may be worn so long as the height of its heel portion upon surface 22 still permits the front planter portion 21*b* of the foot 20 to lie upon platform 12 when the shoe or other foot apparel is placed over front wall 16*a* to lie upon platform 12. Stimulation of platform 12 may be applied directly to the skin along bottom of foot 20 upon platform 12, or when one or more materials are worn on foot 20, such as associated with foot apparel, stimulation of platform 12 is transmitted to the bottom of foot 20 via or through such material(s).

Figure 4B:
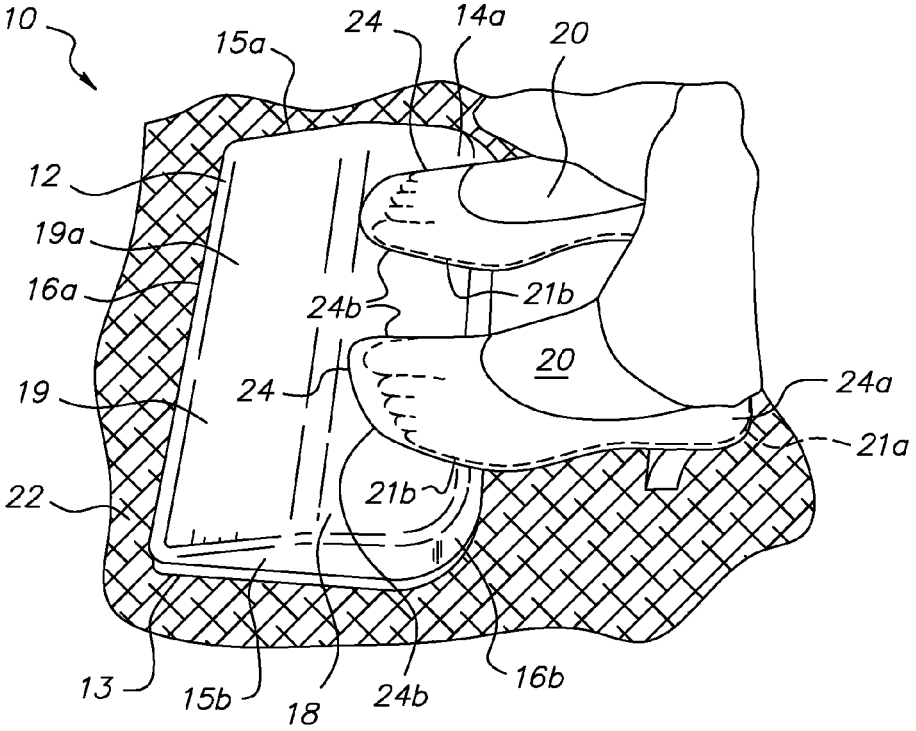
FIG. 4B is an example of rear mode usage of on stimulation device of FIG. 1.

If a shoe 24 is worn with the heel or back portion 24*a* at or near the height of the platform 12 along level portion 18, it may be difficult to use device 10 with such shoes in the above described front mode. Thus, device 10 may be reversed with respect to the foot 20 so that the shoe 24 extends over the back wall 16*b* onto level portion 18, as shown for example in FIG. 4B. This represents a second or rear mode of operating the device 10 with placement of the front plantar portion 21*b* of the foot 20 disposed along the front portion 24*b* of shoe 24 upon level portion 18 and the back end 24*a* of the shoe 24 with foot's back portion 21*a* disposed upon surface 22 off or extending away from device 10. The device 10 may be placed generally flat upon an external surface 22 in front of a user in a seated position, such as in a chair, so that the user need only place his or her front plantar portion(s) 21*b* of one foot or both feet in the first or second mode upon platform 12 to receive stimulation of his or her Meissner Corpuscles along such portion(s) 21*b* when platform is driven as described below. In the front mode, the roundness or front wall 16*a* at top surface 14*a* promotes comfort of user placement of foot or feet 20 upon platform 12.

Although the above describes the preferred contour or shape of surface 14*a* of platform 12 for ease of use with foot or feet of a user or person seated in front of the device 10 to face the front or back thereof, other contour or shape of surface 14*a* may be provided, if desired. For example, in a less preferred embodiment provides only sloped portion 19 with device 10 sized to reduce or remove level portion 18.

Stimulation or motion is applied to platform 12 by two inertial actuators 28 fixed to the underside surface 14*b* of platform 12, such as by screws 29 into threaded holes molded along surface 14*b*. A circuit board 30 is also fixed below the underside surface 14*b*, such as by screws 31 into threaded holes molded along surface 14*b*, with electronics (see FIG. 10) that provides drive signals to the actuators 28 via wires 28*a* to move platform 12 in positive and negative displacement at a desired frequency in the range of 10-75 Hz. Such frequency being 45 Hz in the preferred embodiment at a user adjustable amplitude level of the stimulation motion. The electronics mounted upon circuit board 30 and operation of device 10 will be described below in more detail. Circuit board 30 is so located below surface 14*b* and spaced therefrom for electronic components along the board's top side that are not visible in FIG. 5.

Actuators 28 are referred to as inertial actuators since they may be electrically inertia actuated devices which convert electrical audio frequency signals into mechanical forces that can impart motion. Each inertial actuator has an exciter that uses an internal inertia mass to resist the force generated by the sinusoidal current flowing through a voice coil to produce a reactive force against the solid surfaces of the platform the inertial actuators are mounted to. For example, the inertial actuators 28 may be Dayton Audio TT25-16 (16 ohm) or TT25-8 (8 ohm) Puck Tactile Transducer Mini Base Shake 300-388. Although two actuators 28 are shown, a single centrally located actuator along back surface 14*b* may alternatively be used, or more than two actuators 28 along surface 14*b*, depending on the size of platform 12 and number needed to provide the desired stimulation force. Inertial actuator(s) are preferred in device 10, but other types of actuator(s), oscillator(s), or electrical to mechanical transducer(s) may be used that can be fixed to a member, such as platform 12, and driven to apply force(s) that moves the platform as described herein.

Figure 5:
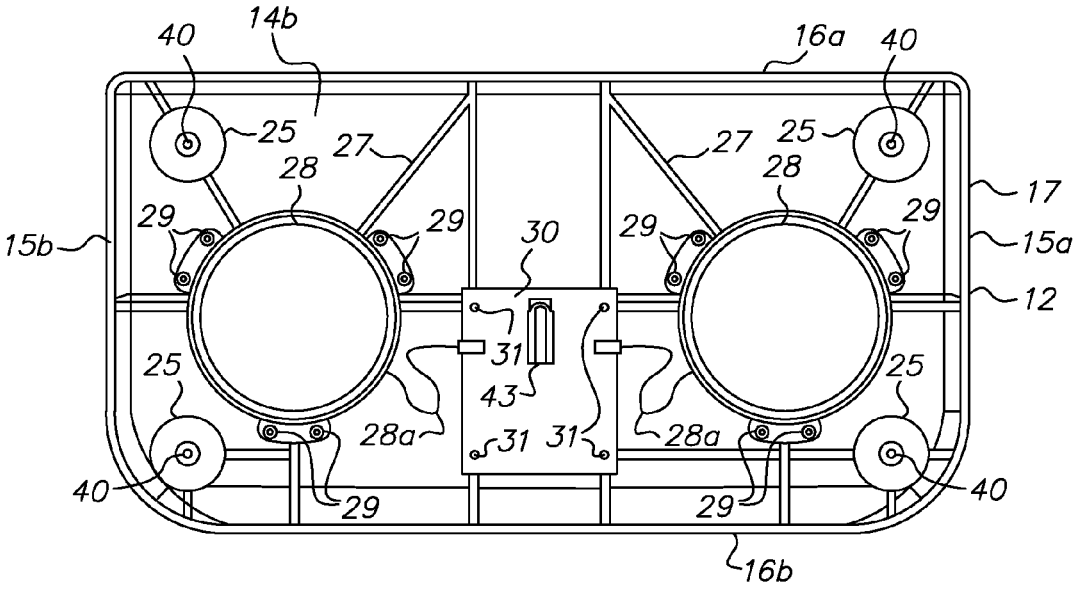
FIG. 5 is a view of the underside platform of the stimulation device of FIG. 1 with the base and motion guides of the device removed.
Figure 6:
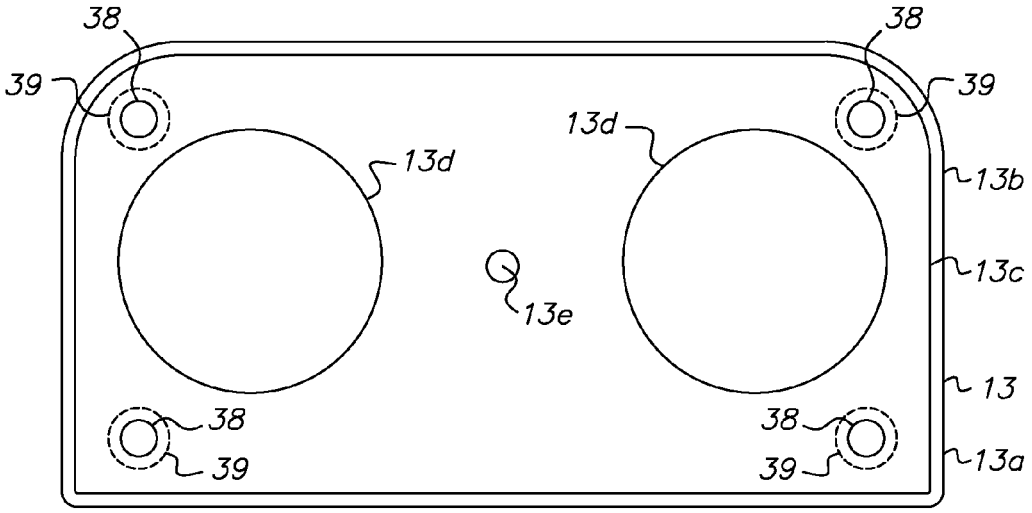
FIG. 6 is a view of the top of the base of the stimulation device of FIG. 1 with the platform and motion guides of the device removed.

Platform 12 has four cylindrical posts 25 that extend downward from the platform's underside surface 14*b* to a common level or x-y plane, as shown in FIG. 5. Ribs 27 are provided along surface 14*b* to provide structural support to platform 12. Facing each post is one of four circular openings or holes 38 through base 13 of a first diameter, where each hole 38 extends to a larger second diameter opening 39 along the bottom side of base 13, as shown in FIG. 6. Along posts 25, extending through holes 38, are disposed four motion guides 26 which both support platform 12 over base 13 and enable platform 12 to move up and down in positive and negative displacement with respect to the base 13 along the z axis shown in FIGS. 1 and 2.

Figure 7B:
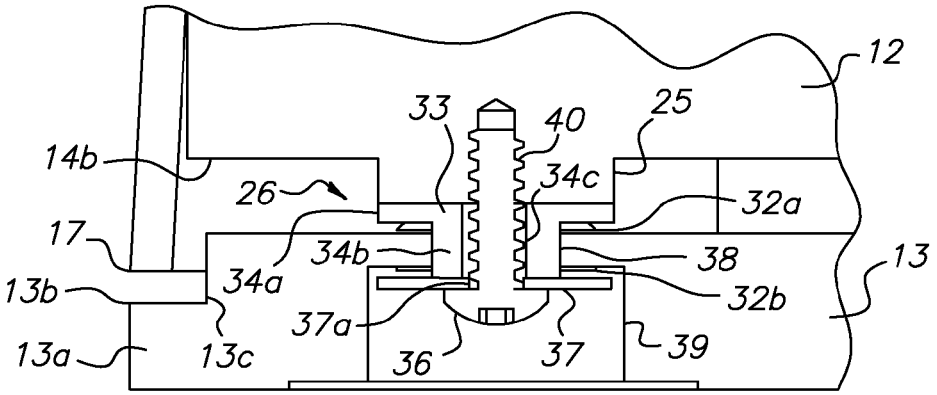
FIG. 7B is a more detailed view of one of the motion guides of the stimulation device of FIG. 1 enabling up and down motion of the platform of the device with respect to its base.
Figure 7C:
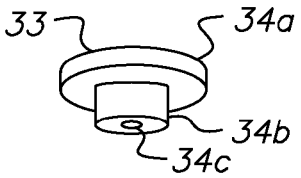
FIG. 7C is a perspective view of one of the motion guides of the stimulation device.

Each motion guide 26 has a guide member 33 having an upper flange 34*a* and a lower cylindrical portion 34*b*, a flexible joint member 32*a*, and a retainer member provided by a screw 36 and a washer 37 for fixing the guide member 33 to platform 12 so that the guide member 33 is movable in hole 38 upon flexible joint member 32*a* in order to direct the motion of platform 12 in only positive and negative vertical displacement along the z axis. Guide member 33 is made of a low-friction type of material so that lubrication is not needed, and cylindrical portion 34*b* of guide member 33 has an outer diameter slightly less than the diameter of hole 38. With flexible joint member 32*a* disposed around the cylindrical portion 34*b* of guide member 33, upper flange 34*a* of the guide member 33 is located upon one of posts 25 so that lower cylindrical portion 34*b* extends downward and is received through hole 38 of base 13 and flexible joint member 32*a* located in a gap between upper flange 34*a* and base 13, as best shown in FIG. 7B. The lower end of cylindrical portion 34*b* extends though hole 38 of base 13 partially into opening 39. In opening 39, a screw 36 is extended through the central aperture 37*a* of washer 37, a hole 34*c* that extends though both cylindrical portion 34*b* and flange 34*a* of guide member 33, and is then tightened in a threaded hole 40 centrally disposed in post 25.

Figure 8:
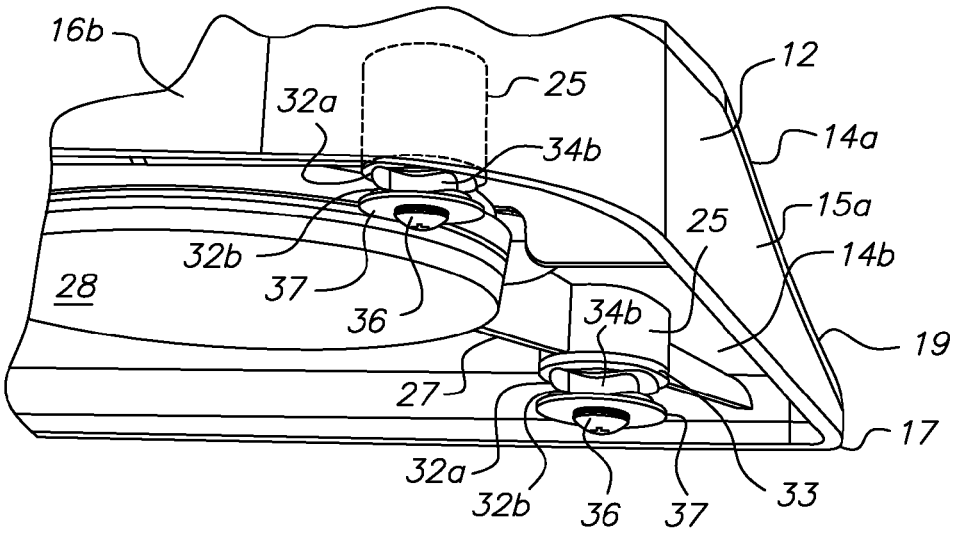
FIG. 8 is a broken perspective view of the platform of the stimulation device of FIG. 1 with the base removed showing two of the motion guides of the device.

Another flexible joint member 32*b* is preferably provided around the end of cylindrical portion 34*b* of guide member 33 that extends through hole 38 into opening 39. Flexible joint member 32*b* is located in the gap formed between washer 37 and base 13 when washer 37 is maintained by screw 38 in abutment to the end of cylindrical portion 34*b* of guide member 33 that extends through hole 38. The flexible joint member 32*b* provides a pre-load force upon guide member 33 and minimizes noise during motion of the motion guide 26 along hole 38 when platform 12 moves with respect to base 13. For purposes of illustration, the assembly of two of the motion guides 26 is shown in FIG. 8 with base 13 removed.

Flexible joint members 32*a* and 32*b* may each be a steel washer that is corrugated about its surface and has a central opening of a diameter so that it can be received upon cylindrical portion 34*b* of guide member 33. For example, flexible joint member 32*a* may be disc spring wave washer manufactured by McMaster-Carr, model number 9714K14, providing a deflection of 0.047 inches at a maximum work deflection load of 37.5 lbs. Flexible joint members 32*b* may be the same as flexible joint members 32*a*. However, other flexible and/or elastic material for flexible joint members 32*a* and 32*b* may also be used, such as rubber, or coil spring, that provides the desired deflection.

Flexible joint member 32*a* is positioned in a gap between flange 34*a* and base 13 so that applied load upon the platform 12 (plus the weight of the platform 12) is distributed upon joint members 32*a* of the four motion guides 26 provided near each of the rounded corners of the device 10. Thus, in the case where each of the flexible joint members 32*a* has a maximum work deflection load of 37.5 lbs., then maximum weight applied load upon the platform 12 (plus the weight of the platform 12) is four times this value or 150 lbs.

Figure 9:
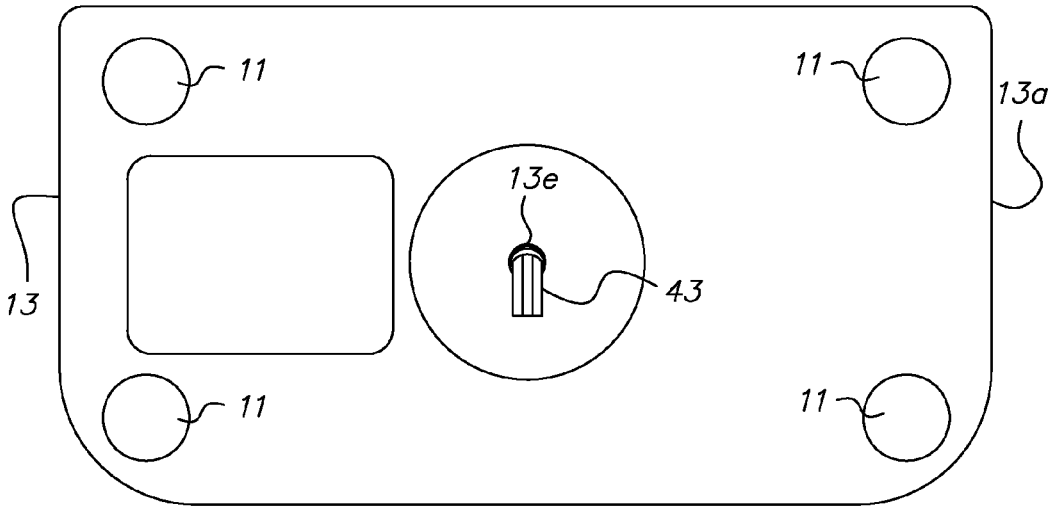
FIG. 9 is a bottom view of the stimulation device of FIG. 1.

Platform 12 freely floats over base 13 upon the motion guides 26 so that it can move or vibrate with respect to base 13. Due to the size of actuators 28, the height of base 13 may be recessed along regions 13*d* (FIG. 6) facing actuators 28 to assure non-contact of base 13 with the actuators 28. The base may have a hole 13*e* (FIG. 6) extending there through for passing a power cord connector 43 (FIG. 5) which extends downward from circuit board 30 and through such hole 13*e* and below base 13 (FIG. 9). Such power cord connector 43 may be coupled to a mating connector of cable to an external AC wall adapter or battery for supplying power to components on circuit board 30. As pads 11 raise the height of base upon external surface 22, access to connector 43 is provided while maintaining device 10 level upon surface 22. The connector 43 does not interfere with the motion of platform 12 with respect to base 13, since the hole 13*e* for connector 43 is larger than the diameter of connector 43 as it extends downward perpendicular with respect to board 30, so that the connector will freely move up and down in such hole 13*e* when platform 12 moves with respect to base 13. After extending vertically through hole 13*e*, connector 43 may be at an angle to the horizontal as shown in FIG. 9, and such connector 43 may optionally be mounted in device 10 to be rotatable about the z axis, if desired. For purposes of illustration, connector 43 is not shown in FIGS. 2 and 3.

For example, device 10 has a maximum width of about 7.5 inches, a length of 14 inches, and a height above external surface 22 of 1 inch at the lowermost part of surface 14*a* at front wall 16*a*, and 2 inches along level portion 18. The height of the device varies in vertical displacement, such as up to ±50 microns (100 microns of total travel peak to peak), due to varying up and down motion of platform 12 with respect to base 13 when actuators 28 are operated. The level portion 18 and sloped portion 19 are shown in FIGS. 1 and 2 sharing about half of top surface 14*a* of platform 12, where level portion 18 smoothly transitions to sloped portion 19. However other dimensions may be used so long as the front plantar portion 21*b* of the foot or feet 20 can be positioned upon the device 10, i.e., platform 12, to receive stimulation without requiring the user to stand with both feet on platform 12 to receive stimulation via their feet. The device 10 may weigh under 5 lbs. and is compact so that it is readily portable and useable in the home, office, clinical environments, in transportation vehicles, aircraft, or other venues.

Figure 10:
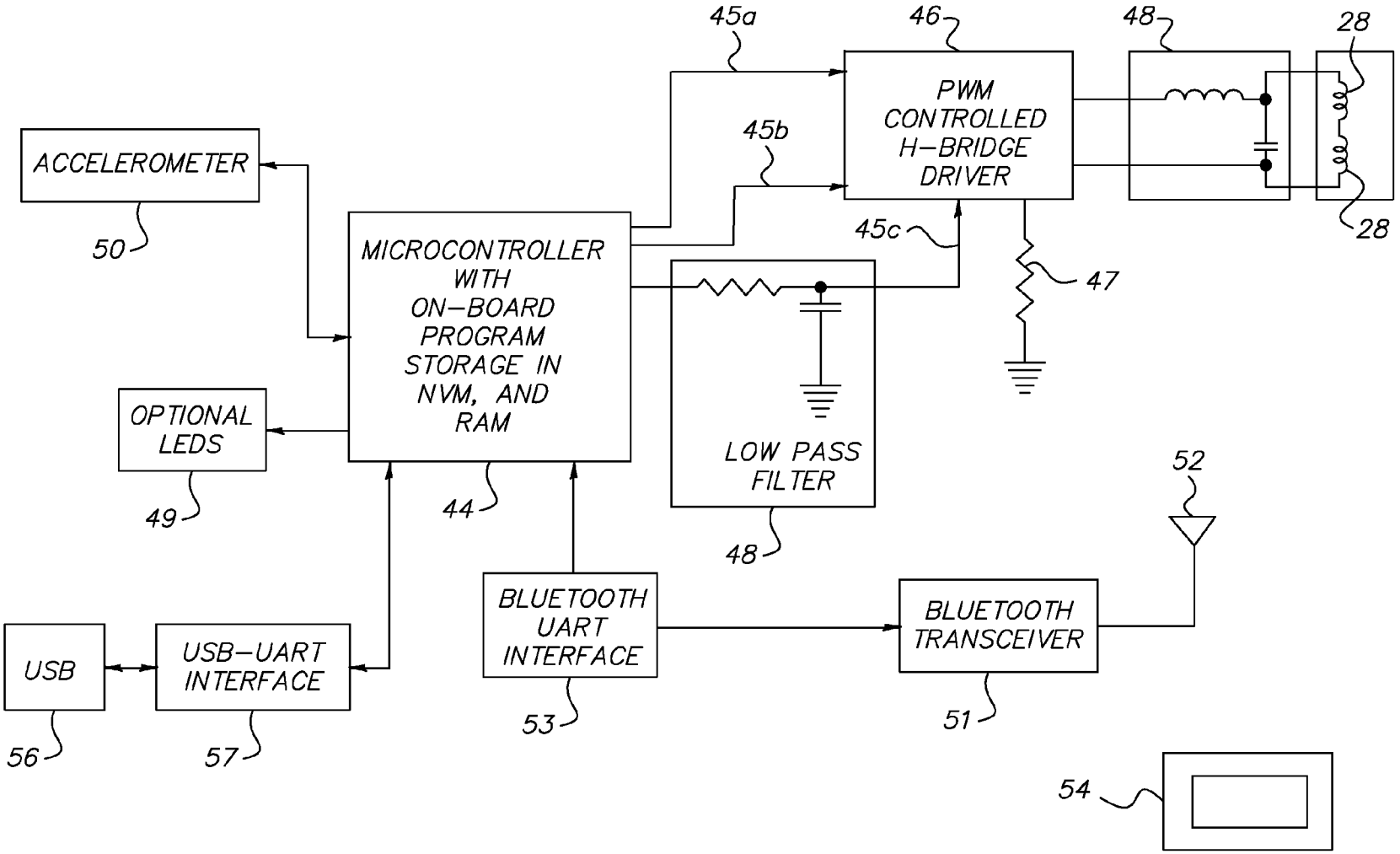
FIG. 10 is a block diagram of the electronics of the stimulation device of FIG. 1.

Referring to FIG. 10, a block diagram of the electronics of circuit board 30 is shown, in which all components shown are present upon the circuit board, except for actuators 28 which are attached to platform 12, and an external device 54 for remote control of device 10. The circuit board 30 includes a microcontroller (microprocessor or controller) 44 operating in accordance with software or a program stored in its internal non-volatile memory (e.g., EEPROM). Microcontroller 44 also has internal memory in the form of RAM for storing variables and flags needed during operation described in FIGS. 12A-12E. The microcontroller 44 outputs digital signals (e.g., high—1 or low—0) to digital inputs 45*a* and 45*b* of an H-Bridge PWM driver 46, and outputs a digital signal which is converted into analog DC voltage reference (Vref) input 45*c* of driver 46. Preferably such conversion is by a digital to analog converter (DAC) on the circuit board. In the embodiment shown in FIG. 10, the digital to analog conversion is provided using a low pass filter 48 by microcontroller 44 outputting a digital signal as a pulse with an on-time or width that builds the desired voltage at the capacitor of the low-pass filter 48. Thus modulation of the width of pulses by microcontroller 44 to low pass filter 48 can produce desired analog voltage levels at input 45*c* of driver 46, as commonly performed when a DAC is not used. However other digital to analog signal convertors may be used, or if available an analog voltage output provided from microcontroller 44. The DC voltage Vref amplitude at input 45*c* controls the peak current level (and thus the power) of the output drive signal of driver 46 to actuators 28. For example, microcontroller 44 may be an Atmel Model No. ATmega2560, and driver 46 may be an Allegro Microsystems PWM driver IC model no. A4950, where an external resistor 47 establishes the upper drive current limit of the signal to actuators 28 settable by Vref at input 45*c*, as per the manufacturer of the PWM driver 46.

Driver 46 is connected to actuators 28, via 2-pole low pass filter 48, and when input 45*a* is high (or on), driver 46 applies a signal to serially connected actuators 28 at a drive current set by Vref value at input 45*b*. The direction (+ or −) of current of the signal applied by driver 46 to actuators 28 is set by the digital value at input 45*b*, either high or low. The voltage of the applied signal by the driver 46 is set in according with the ohm rating of the actuators 28. For example, the applied voltage of such signal may be +/−12V depending on the current direction, where each actuator 28 is a 16 ohm Dayton Audio Model Puck TT25-16. It has been found that the longer on-time or width of a pulse of the signal applied by driver 46 to the actuators 28, the actuators receive more energy/power until reaching their maximum current level as set by Vref. Thus by microcontroller 44 controlling the on-time or width of pulses and the current direction applied to driver 46, a sinusoidal varying drive current signal can be generated by driver 46 at the desired frequency, such as 45 Hz, in the preferred embodiment for the stimulation of the Meissner's Corpuscles. This drive current applied to actuators 28 causes a periodic, e.g., sinusoidal, varying amplitude of motion of positive and negative displacement of platform 12 with respect to base 13.

In order to generate a sinusoidally varying drive current signal to actuators 28, the microcontroller 44 applies pulses to input 45*a* of driver 46 which are modulated in width (on-time) and in direction (+ or −) set at input 45*b* of driver 46 in accordance with stored table in non-volatile memory of the microcontroller 44. For example, the sinusoidal cycle at the desired 45 Hz, is divided into 128 samples providing a pulse width modulation (PWM) frequency, $F_{PWM}$, of 3600 Hz. Over the first half of the cycle of 64 pulses, the on-time (or width) of each successive pulse increases from zero to the peak of the cycle and then decreases back to zero with positive (+) current direction, in accordance with entries in the table for such samples. Over the second half of the cycle of the next 64 pulses, the on-time of each successive pulse increases from zero to the peak of the cycle and then decreases back to zero with negative (−) current direction, in accordance with entries in the table for such samples. This cycle of signals at inputs 45*a* and 45*b* then repeats to establish the sinusoidally varying drive current applied by driver 46 to actuators 28 when driver 46 is being actuated by microcontroller 44.

Figure 11:
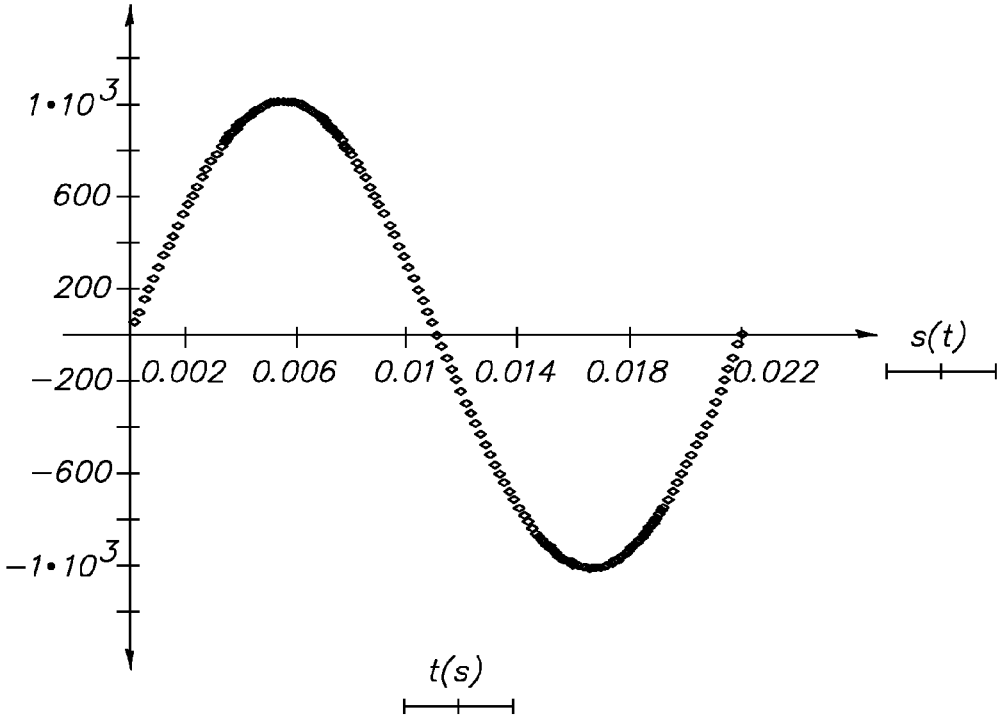
FIG. 11 is a graphical illustration of 128 samples used for applying pulses of different width modulation (on-time) along a sinusoidally varying cycle applied to the driver of the inertial actuators of the device.

The theory for establishing the sinusoidally varying signal at 45 Hz using a stored table of sine wave samples corresponding to N=128 samples of one complete cycle, is shown in the graph of FIG. 11 and generated by the following two equations:

$$s(t):=A\cdot\sin(2\cdot\pi\cdot t\cdot F_{PWM})$$

$$t:=0\cdot s,\ 1/(N\cdot F_{PWM})\ \ldots\ (1\cdot s)/45$$

where t is time, s(t) is displacement, A is ±peak amplitude, $F_{PWM}$ is the desired pulse width modulation frequency, and number 45 is the selected drive signal frequency in Hertz. In the FIG. 11 example, A is set to ±1000.

Any number of N samples can theoretically be used, however, there are significant trade-offs to be considered. As the number of cycles increases, so too does the PWM frequency $F_{PWM}$. Conversely, as N decreases, $F_{PWM}$ decreases, making the PWM filter requirements more difficult to obtain because there is less separation between the desired frequency, e.g., 45 Hz, and rejection frequency ($F_{PWM}$). These sampled values are stored in such table in non-volatile memory and can be continually played back by microcontroller 44 using inputs 45*a* and 45*b* of driver 46 to produce a sinusoidally varying drive current signal applied to serially connected actuators 28 that causes such actuators to respond with a stimulation force of sinusoidally varying amplitude of positive and negative displacement (or vibration) of platform 12 at the selected frequency. Thus, the microcontroller 44 may be considered as providing a PWM generator that produces a series of pulses whose on-time varies according to the value from the table. Preferably, pulse width modulation is used (versus other forms of power drive) due to its high efficiency which minimized power dissipation within the device (and hence reduces heat). Although the frequency of 45 Hz has been selected, other frequencies of sinusoidal varying amplitude may similarly be selected such as in the range of 10-75 Hz.

To generate each successive pulse, the microcontroller 44 has an internal free-running PWM drive counter that is compared to a limit register named 'TOP' set to the value of the on-time counts for that pulse read from the table. When equal, the PWM drive counter is reset. Thus the PWM frequency, $F_{PWM}$, i.e., the time it takes the counter to complete a counting cycle, is controlled by both its clock frequency (e.g., 16 MHz) and the value in the TOP register. The value of TOP (minus 1) is the maximum PWM on-time count value available. The output (PWM) pulse width is in counts (or ticks) of the free-run counter frequency (16 MHz). A pulse on-time count (or tick) is 1/16 MHz or 62.5 nanoseconds.

The table below shows an example of the above described table storing the on-time counts of each of the 128 sample pulses in each cycle, as graphically illustrated by the curve shown in FIG. 11, where the negative (−) or positive (+) indicates the setting at input 45*b* of driver 46:

TABLE

| Pulse No. | On-time counts |
|---|---|
| 1 | 0 |
| 2 | +136 |
| 3 | +272 |
| 4 | +407 |
| 5 | +541 |
| 6 | +674 |
| 7 | +806 |
| 8 | +935 |

TABLE-continued

| Pulse No. | On-time counts |
|---|---|
| 9 | +1062 |
| 10 | +1187 |
| 11 | +1309 |
| 12 | +1427 |
| 13 | +1542 |
| 14 | +1654 |
| 15 | +1761 |
| 16 | +1864 |
| 17 | +1963 |
| 18 | +2057 |
| 19 | +2146 |
| 20 | +2230 |
| 21 | +2308 |
| 22 | +2381 |
| 23 | +2449 |
| 24 | +2510 |
| 25 | +2565 |
| 26 | +2614 |
| 27 | +2657 |
| 28 | +2693 |
| 29 | +2723 |
| 30 | +2746 |
| 31 | +2763 |
| 32 | +2773 |
| 33 | +2776 |
| 34 | +2773 |
| 35 | +2763 |
| 36 | +2746 |
| 37 | +2723 |
| 38 | +2693 |
| 39 | +2657 |
| 40 | +2614 |
| 41 | +2565 |
| 42 | +2510 |
| 43 | +2449 |
| 44 | +2381 |
| 45 | +2308 |
| 46 | +2230 |
| 47 | +2146 |
| 48 | +2057 |
| 49 | +1963 |
| 50 | +1864 |
| 51 | +1761 |
| 52 | +1654 |
| 53 | +1542 |
| 54 | +1427 |
| 55 | +1309 |
| 56 | +1187 |
| 57 | +1062 |
| 58 | +935 |
| 59 | +806 |
| 60 | +674 |
| 61 | +541 |
| 62 | +407 |
| 63 | +272 |
| 64 | +136 |
| 65 | 0 |
| 66 | −137 |
| 67 | −273 |
| 68 | −408 |
| 69 | −542 |
| 70 | −675 |
| 71 | −807 |
| 72 | −936 |
| 73 | −1063 |
| 74 | −1188 |
| 75 | −1310 |
| 76 | −1428 |
| 77 | −1543 |
| 78 | −1655 |
| 79 | −1762 |
| 80 | −1865 |
| 81 | −1964 |
| 82 | −2058 |
| 83 | −2147 |
| 84 | −2231 |
| 85 | −2309 |
| 86 | −2382 |

TABLE-continued

| Pulse No. | On-time counts |
|---|---|
| 87 | −2450 |
| 88 | −2511 |
| 89 | −2566 |
| 90 | −2615 |
| 91 | −2658 |
| 92 | −2694 |
| 93 | −2724 |
| 94 | −2747 |
| 95 | −2764 |
| 96 | −2774 |
| 97 | −2777 |
| 98 | −2774 |
| 99 | −2764 |
| 100 | −2747 |
| 101 | −2724 |
| 102 | −2694 |
| 103 | −2658 |
| 104 | −2615 |
| 105 | −2566 |
| 106 | −2511 |
| 107 | −2450 |
| 108 | −2382 |
| 109 | −2309 |
| 110 | −2231 |
| 111 | −2147 |
| 112 | −2058 |
| 113 | −1964 |
| 114 | −1762 |
| 115 | −1655 |
| 116 | −1543 |
| 117 | −1428 |
| 118 | −1310 |
| 119 | −1188 |
| 120 | −1063 |
| 121 | −936 |
| 122 | −807 |
| 123 | −675 |
| 124 | −542 |
| 125 | −408 |
| 126 | −273 |
| 127 | −137 |

For example, in the above table at the positive peak of the sinusoidal curve the number is a pulse of 2776 counts on-time, which generates a pulse at input 45*a* that is 2776/16 MHz seconds wide or 173.5 microseconds in duration. Although the above is the preferred embodiment, other pulse width modulated signals may be used with other clocking of on-time to create desired actuator drive current curves. For example, partial or non-sinusoidally periodic varying curves may be provided at a desired stimulation frequency by adjusting entries in the table. Further, multiple different tables could be stored in non-volatile memory of the microcontroller which may be selected via a user interface for the device to provide different stimulation waves of platform movement.

The software in microcontroller 44 uses an internal variable DRIVE having a value representative of the drive current output from driver 46 to actuators 28. Microcontroller 44 sets the Vref level at input 45*c* of driver 46 based on the value of DRIVE. As stated earlier, Vref is a DC voltage whose amplitude provides the desired peak current (and hence power) of the output signal of driver 46 per the manufacturer of driver 46. By choosing the cutoff frequency of low-pass filter 48 at least a factor of ten lower than the PWM frequency of microcontroller's PWM output to input 45*a*, the relationship of DRIVE value to Vref level is computed in microcontroller 44 as $Vref=Vcc*DRIVE/2^n$, where Vcc is microcontroller's 44 supply voltage, typically 5V, and n is the number of bits in the PWM generator, typically 10. So, for example, setting DRIVE to 50 produces 5*50/1024 volts, approximately 244 mV signal at input 45*c*. This in turn sets the peak drive current at 0.244 divided by the ohm value of resistor 47. As will be described later, DRIVE is the mechanism by which the amplitude of motion of platform is regulated as the load applied to platform 12 varies.

The DRIVE value (and hence Vref level at input 45*c*) preferably is adjusted by microcontroller 44 when motion is applied to platform 12 by actuators 28 so that driver 46 will, for example, cause actuators 28 to vibrate at or near a user desired target level of + peak to − peak amplitude of sinusoidal motion of platform 12 along the z axis. This target stimulation level is stored in a variable called COMMAND, which is a value adjustable by the user as described below. A COMMAND value may also be stored in non-volatile memory for use when needed to set the value of the COMMAND variable, such as at start-up of device 10. The COMMAND value is in terms of the amplitude of acceleration of platform 12 motion, and such acceleration amplitude is directly proportional to peak-to-peak amplitude of stimulation motion of platform 12 at its frequency of oscillation. In other words, the amplitude of motion of platform 12 increases linearly as the amplitude of the acceleration of platform 12 increases until the upper mechanical limit of motion guides 26 or the power limit of driver 46 is reached. COMMAND may have a value between 0 and 8192, where values are in terms of acceleration amplitude that are proportional to desired peak-to-peak amplitude level of stimulation. The range of COMMAND values are typically limited during operation to a desired range, such as 300 to 7000, associated with maximum and minimum levels of stimulation. For example, stimulation levels of 20 μm, 35 μm, 50 μm, 65 μm, 80 μm correspond to COMMAND values of 780, 1080, 1360, 1700, and 2010, respectively. It is believed that 50 μm peak-to-peak motion (or stimulation level) will provide about 0.2 g amplitude of acceleration (i.e., ±0.2 g peak to peak), where $g=9.8\ m/sec^2$.

Prior to any load or mass (or downward force) being present on platform 12, COMMAND values of 780, 1080, or 1360 for example results in DRIVE values of 700, 1250, and 1900, respectively. In operation, a load or mass (or downward force) will be applied upon platform 12, such as when front portion 21*b* of a foot or feet 20 is placed upon device 10. When a load is so applied this will tend to dampen the peak-to-peak motion, and the user may increase COMMAND level accordingly. However, preferably device 10 automatically adjusts for this increase in load upon platform 12 to maintain a user's desired level of stimulation motion associated with a COMMAND value and therefore the desired stimulation of the Meissner's Corpuscles. Thus, as described below in connection FIGS. 12A-12E, in order to maintain the stimulation performance associated with a desired COMMAND level, the microcontroller 44 actively adjusts the DRIVE value in real-time (and hence Vref level at input 45*c* of driver 46) in accordance with detected changes (within a tolerance value) of amplitude of actual acceleration of platform 12 from the desired COMMAND level. The microcontroller 44 determines such value of actual amplitude of acceleration of platform 12 using acceleration data in x, y, and z orthogonal dimensions received from an accelerometer 50 on circuit board 30, as described below in connection with FIG. 12B. The determined value of actual amplitude of acceleration of platform 12 is stored by microcontroller 44 in an AMPL variable. Acceleration data is provided in each orthogonal dimension x, y, and z in the range of ±4096 on a ±2 g scale. For example, the accelerometer IC may be a Freescale Model No.

MMA8652FC where full scale is set to 2 g, providing a measurement range of −2 g to +1.999 g where and each count (or bit) corresponds to (1/1024) g (0.98 mg) at 12-bit resolution. The accelerometer periodically provides acceleration data to an input port of the microcontroller 44, such as every 1/400 seconds.

The accelerometer 50 also sends to the microcontroller 44 a signal indicating when a tap has been received in the +/− y axis direction, such as by a user tapping upon the device 10 with their foot or a hand on side walls 15*a* or 15*b*. The tap signal represents user input to toggle (or switch) device 10 stimulation from either on to off, or off to on, depending on the current state of device 10 operation. Such tap signal from accelerator 50 may be received by microcontroller 44 as a software interrupt.

The microcontroller 44 stores in its RAM memory a PUCK on/off flag which controls whether signals are being sent or not along inputs 45*a*, 45*b*, and 45*c* to driver 46 for vibrating platform 12. When the PUCK flag is "off", then input 45*a* at driver 46 is maintained as a digital low or 0 level, which stops driver 46 operation and hence halts actuators 28 from moving platform 12. The PUCK flag is thus toggled in state when microcontroller 44 receives a signal from accelerometer 50 indicating a tap upon device 10.

The microcontroller 44 communicates with a user via a Bluetooth (wireless) transceiver 51 having an antenna 52 on the circuit board 30. For example Bluetooth transceiver IC may be a Microchip Model RN41. A Bluetooth enabled external device 54, such as a Smartphone, tablet, laptop, or other microprocessor programmable device, with a Bluetooth communication feature which is paired with Bluetooth transceiver 51 as conventionally performed. Interfaces in the microcontroller 44 and Bluetooth (wireless) transceiver 51 enable serial data communication between microcontroller 44 and the transceiver 51. However, such serial communication interlace may optionally be provided by a separate component, such shown by Bluetooth UART Interface 53.

Figure 13:
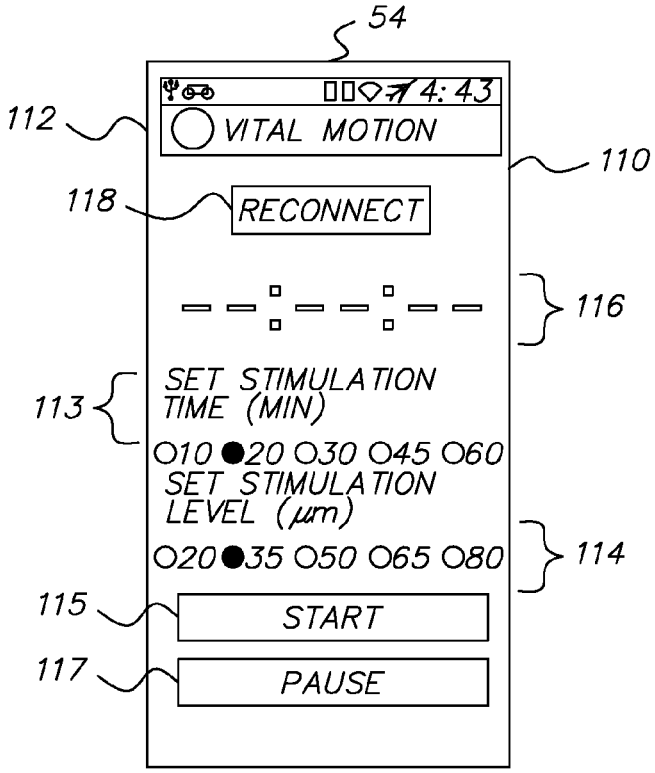
FIG. 13 is an example of an external device, such as smartphone, for wireless remote control operation of the stimulation device of FIG. 1.

Bluetooth transceiver 51 operates responsive with external Bluetooth enable device 54, if within proximity range of antenna 52 on circuit board 30, for typical pairing of a Bluetooth connection for communication between microcontroller 44 and the program/application operating on external device 54 enabling interaction with the microcontroller. An example of a user interface screen of such a program/application is shown in FIG. 13. Although there may be more than one device 54 available, only one at time is paired with Bluetooth transceiver 51. Such transceiver 51 may automatically connect to external device 54 for communication therewith if previously paired for connection with device 54, and if such device 54 is within range of antenna 52. Although wireless communication is described by Bluetooth, other transceivers may be used to provide different wireless communication, such as WiFi, infrared and ultrasound transceivers. Further, additional transceiver (s) with associated antennas may be provided on circuit board 30 in communication with microcontroller 44 to provide different wireless communication modalities.

Alternatively, commands and interaction with the microcontroller 44 may be provided via a USB connector 56, via a USB-UART interface 57, for serial communication by USB protocol (e.g., cable) with microcontroller 44. Preferably, the function of USB-UART interface 57 is part of microcontroller 44. USB connector 56 is used for interfacing a personal computer or laptop with the microcontroller 44 by a USB cable, such as during manufacture of device 10.

Figure 12A:
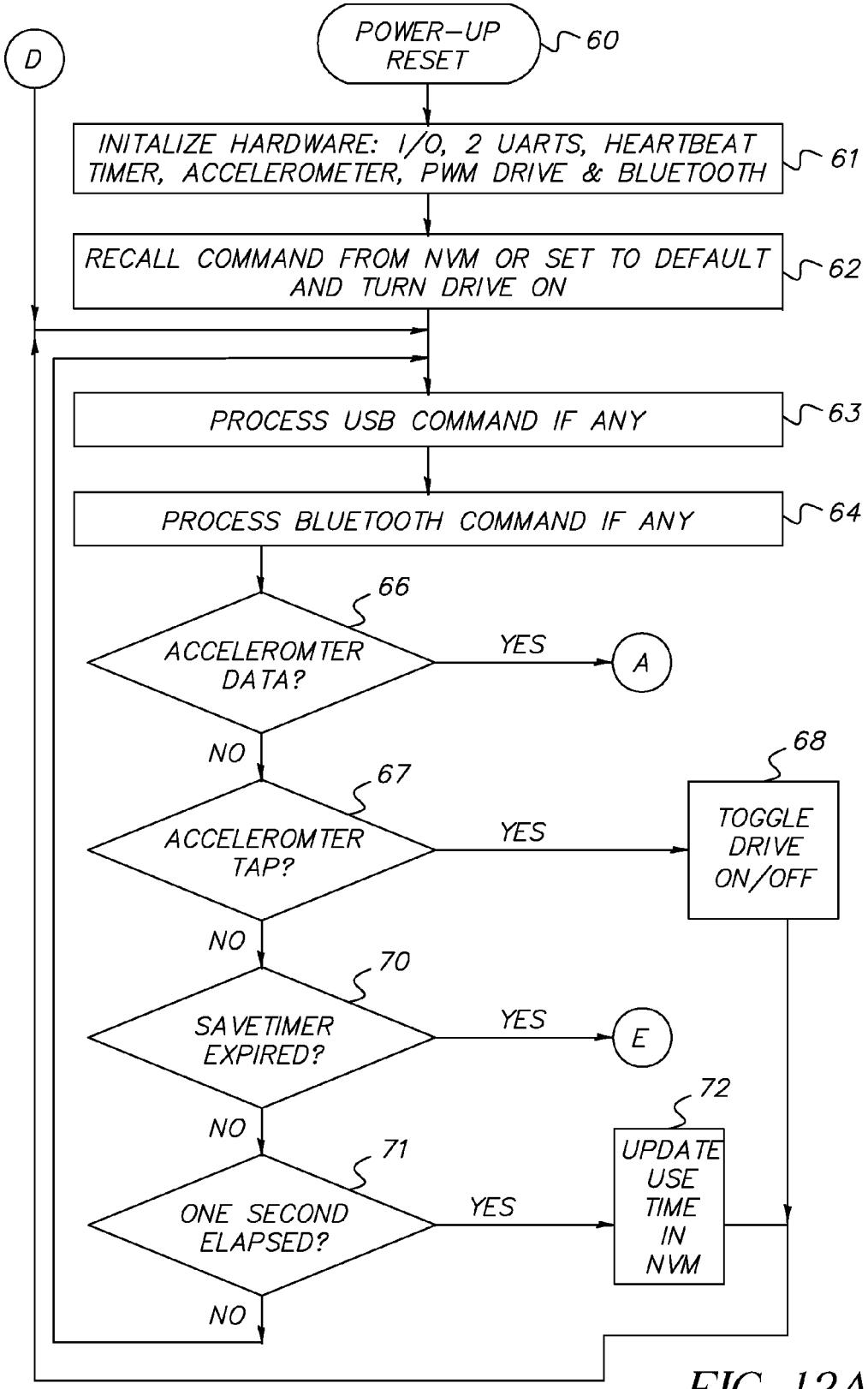
FIGS. 12A-12E is a connected flowchart showing the operation the stimulation device of FIG. 1.

The software or program which controls the operation of device 10 will now be described in more detail in connection with FIGS. 12A-12E which represent connected flowcharts by circled letters A, B, C, D, and E. In FIG. 12A, device 10 starts with power-up reset of microcontroller 44 (step 60). This occurs when power is supplied via connector 43 to circuit board 30. During power-up, the microcontroller 44 starts the program stored in its non-volatile memory, and initializes for operation at step 61, such as the by initializing its input/output ports to other components on circuit board 30, initializing UARTs 53 and 57 (or internal UARTs if part of the microcontroller), internal clock(s), a heartbeat timer which tracks every millisecond of run time, and initializing for PWM drive operation (e.g., starting PWM driver counter) described earlier. Further, applied power initializes other components on circuit board 30 for operation, such as accelerometer 50, and Bluetooth transceiver 51.

The microcontroller 44 recalls a stored user selected target COMMAND value from its non-volatile memory (NVM), and sets the COMMAND variable to that value. If no target COMMAND value is specified (null value) in non-volatile memory, the COMMAND variable is set to a default COMMAND value that may also be stored in non-volatile memory. The default COMMAND value is used if none was stored in non-volatile memory by microcontroller 44 from a previous session or operation of device 10. The drive is turned on by the PUCK flag being set to "on", and microcontroller 44 in response actuates driver 46 to apply a sinusoidally varying current amplitude signal to actuators 28 by sending signals at inputs 45*a* and 45*b* of driver 46 that will tune the DRIVE value so that actual peak-to-peak amplitude of acceleration (AMPL) of platform 12 motion calculated by the microcontroller is at or near the COMMAND value. The initial DRIVE value at step 62 is zero or set to a default value stored in non-volatile memory, and then as shown in FIG. 12D adjusted in every pass through to seek the actual peak-to-peak amplitude of acceleration of platform 12 motion according to the COMMAND value.

The microcontroller 44 then checks if it has received in a buffer any command via USB connector 56 or Bluetooth transceiver 51 (steps 63 and 64). If so, it decodes such command, and responds accordingly. A set of commands is provided in software for external device 54 or other device connected via USB connector 56 to communicate with the microcontroller 44 for controlling operation of device 10 or to determine its status. For example, such commands include: Puck <on/off>, Amplitude closed <COMMAND value>, and Amplitude open <pwm value>. Other commands may be provide as needed for testing operation of device electronics during manufacture or repair. When a Puck command is received followed by "on" or "off", the microcontroller 44 changes the PUCK flag accordingly in memory. When an Amplitude command is followed by "closed" and then a numerical value, the microcontroller 44 stores this value in non-volatile memory as the new user selected target COMMAND value for peak-to-peak amplitude of acceleration of platform 12 motion. Less preferably, the command Amplitude "open" and then a numerical value for a desired DRIVE value is sent, in which microcontroller 44 in response sets and maintains the Vref DC amplitude level associated with such DRIVE value and does not changes Vref or the DRIVE value with load applied upon platform 12.

The external device 54 has a program (or application) for sending and receiving commands enabling user interaction with microcontroller 44. The external device 54 can also query status of operation of the device. For example, sending the command Puck without any following argument returns from the microcontroller 44 to external device 54 and/or other device via USB 56, the state of the PUCK flag, and sending the Amplitude without any following argument returns from the microcontroller 44 to external device 54 and/or other device via USB 56 the current COMMAND value stored in RAM memory of the microcontroller. The external device 54 and/or other device via USB 56 may convert the returned value and display it and/or its associated stimulation level of + peak to − peak motion displacement.

Figure 12B:
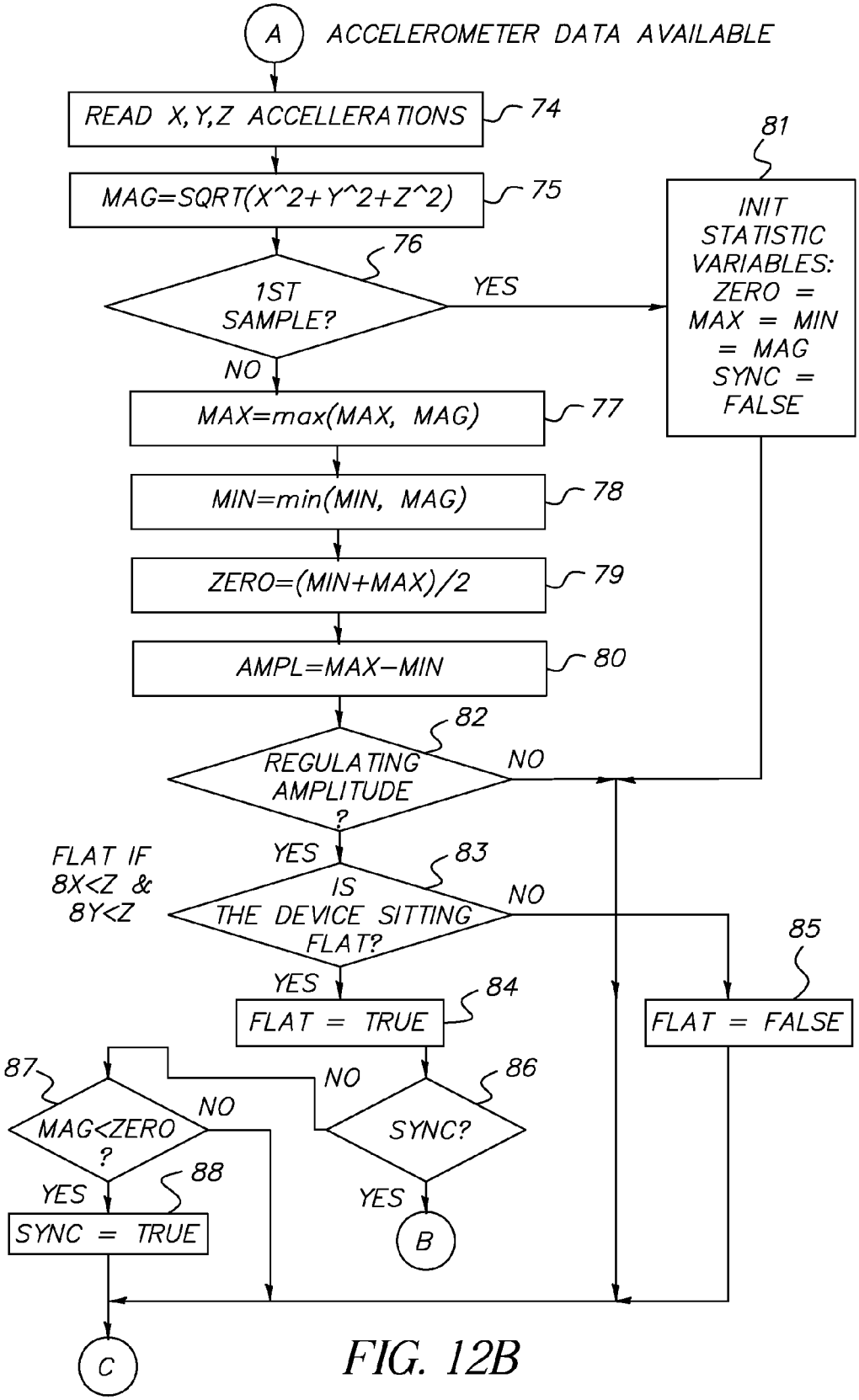
Figure 12C:
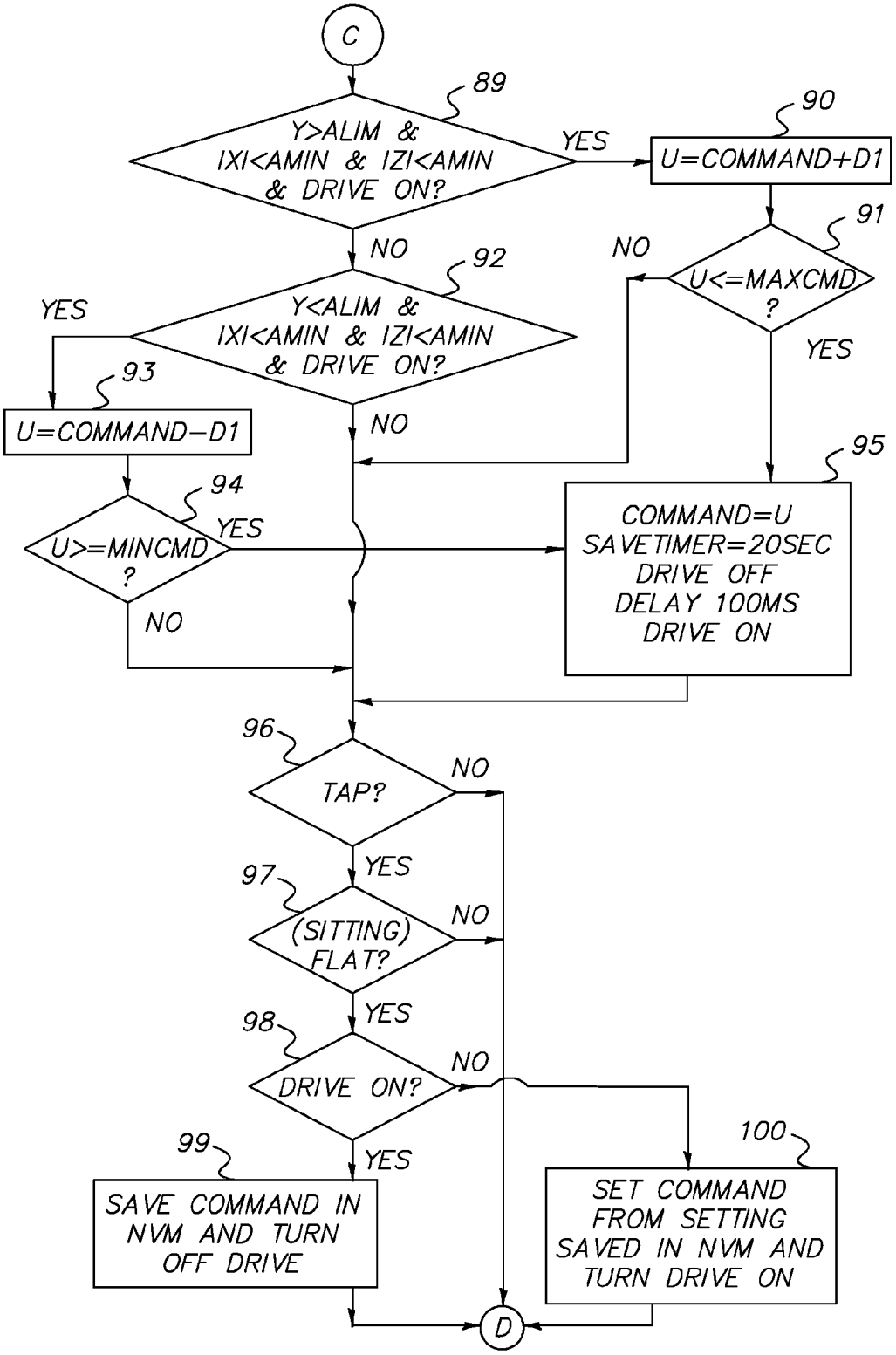
Figure 12D:
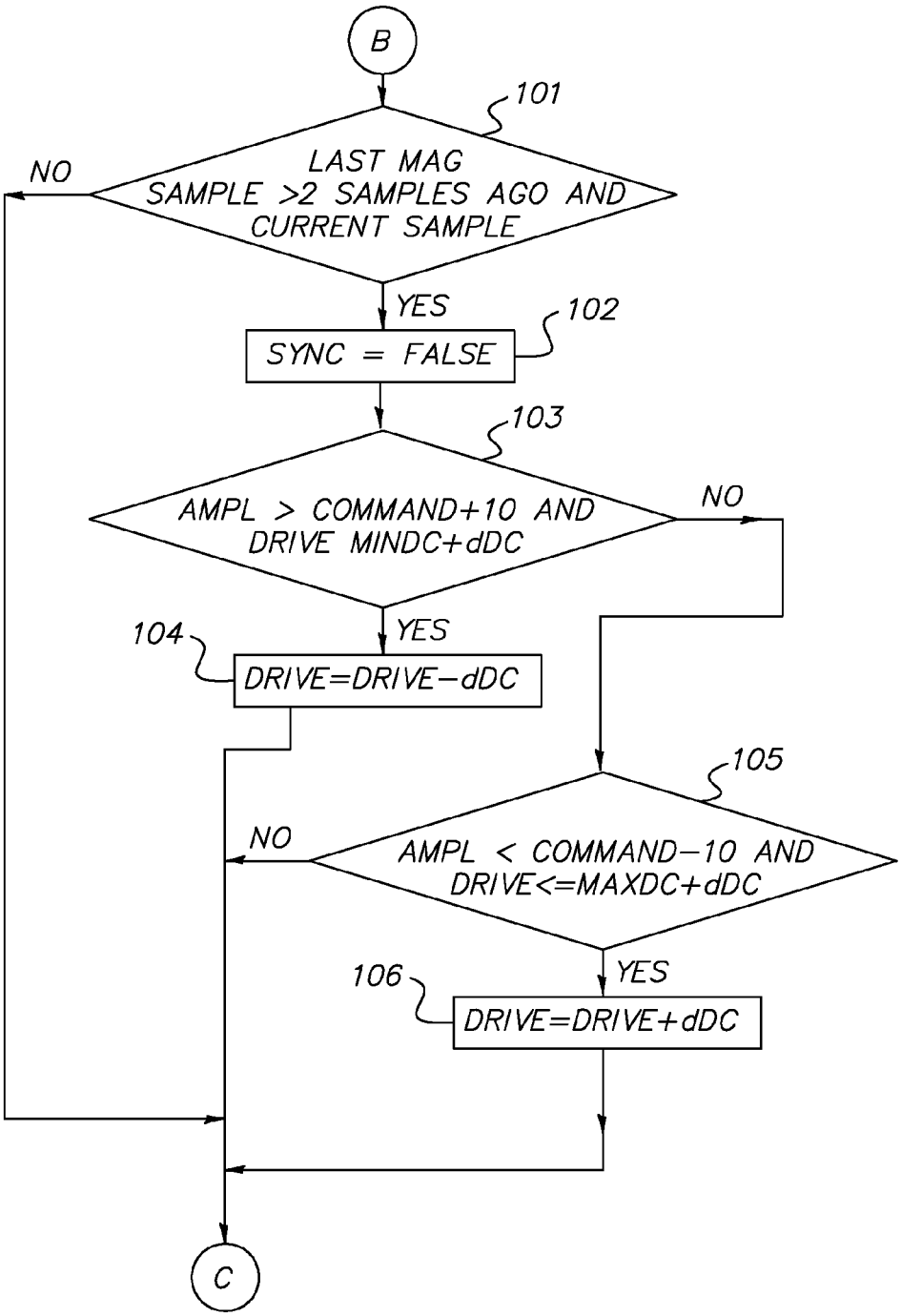
Figure 12E:
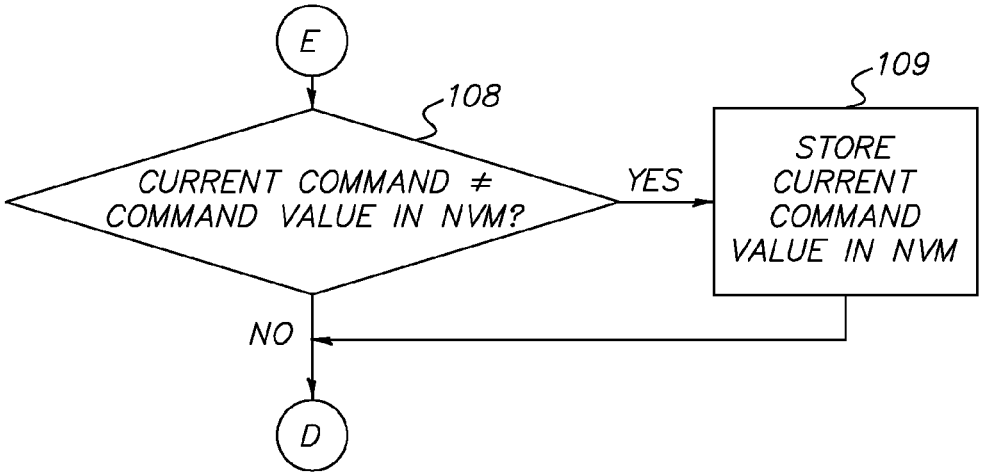

When the microcontroller 44 detects received acceleration data from accelerometer 50 at step 66, it proceeds to step 74 in FIG. 12B and processes such data. The microcontroller 44 reads the acceleration data to obtain the x, y, z acceleration values (step 74), and calculates and stores in its RAM memory the magnitude value, MAG, of acceleration (step 75) where MAG equals to square root of the sum of squares of the x, y, and z acceleration values. The MAG value represents a sample of the current amplitude of acceleration of platform 12 motion as well as acceleration which may be due to movement of the entire device 10. A check is then made as whether this is the first MAG sample calculated (step 76). As this first pass through FIG. 12B, the statistics variables ZERO, MAX, and MIN in RAM memory of microcontroller 44 are set equal to the MAG value, a SYNC flag in RAM memory of microcontroller 44 is set to false (step 81), and the microcontroller 44 continues to step 89 (FIG. 12C). If this is not the first sample read from accelerometer 50, then steps 77, 78, 79, and 80 are performed.

At step 77, microcontroller 44 compares the calculated MAG value with a MAX value, and if MAG is greater than MAX then MAX is set to the MAG value. At step 78, microcontroller 44 compares the calculated MAG value with a MIN value, and if MAG is less than MIN then MIN is set to the MAG value. At step 79, the sum of MIN and MAX is divided by two and the resulting value is stored as ZERO. At step 80, the value of AMPL is calculated by subtracting MIN from MAX. If under close loop control amplitude (step 82), a check is made if device 10 is sitting flat when eight times the x acceleration value is less than z acceleration value read at step 74, and eight times the y acceleration value is less than z acceleration value read at step 74 (step 83). In other words, acceleration of the platform 12 is mostly in the vertical z axis. If the device 10 is determine sitting flat (or level), a FLAT flag in RAM memory of the microcontroller is set to true (step 84), otherwise the FLAT flag is set to false (step 85). As the SYNC flag is false (step 86), a check is made as to whether the MAG value is greater than ZERO value (step 87), and if so the SYNC flag is then set to true (step 88). If the MAG value is greater than zero, then actuators 28 are being driven by driver 46 along increasing positive side of the sinusoidal drive current signal, and thus the MAG and AMP values may be used for controlling the DRIVE value by microcontroller 44 when later branching through step 86 to step 101 of FIG. 12D.

The user may optionally manually set the stimulation level of device 10 by tilting the device 10 to the right or left along the y axis to increase or decrease, respectively, the peak-to-peak stimulation level of platform 12 when keeping little or no tilt along the x and z axis. As shown in FIG. 12C, following step 88, the microcontroller 44 checks at step 89 whether the y acceleration reading is greater than a +ALIM threshold value, the absolute of x acceleration reading is less than a AMIN threshold value, the absolute of z acceleration reading is less than AMIN threshold value, and the PUCK flag is "on" indicating the drive 46 is on and moving platform 12. If so, then at step 90 the variable U value is set to the COMMAND value plus a step value DI. Otherwise, microcontroller 44 at step 92 checks whether the y acceleration reading is less than − ALIM threshold value, the absolute of x acceleration reading is less than a AMIN threshold value, the absolute of z acceleration reading is less than AMIN threshold value, and the PUCK flag is "on" indicating the drive 46 is on and moving platform 12. If so, then at step 93 the variable U value is set to the COMMAND value minus the step value DI.

A check is made after steps 90 or 93 as to whether the value of U is above or below the desired range of COMMAND values within which device 10 will operate. If U is increased at step 90 and the value of U is less than or equal to the value of MAXCMD, i.e., maximum possible value of COMMAND (step 91), then step 95 is performed to change the COMMAND value accordingly. If U is decreased at step 93, and U is greater than or equal to a MINCMD, i.e., minimum possible value of COMMAND, (step 94), then step 95 is performed to change the COMMAND value accordingly. Otherwise, such the value of COMMAND is not updated to U, and microcontroller 44 proceeds to step 96.

The thresholds ALIM, AMIN, MAXCMD, MINCMD, and step value of DI are stored in non-volatile memory for use by microcontroller 44. ALIM represents an acceleration value, typically 2000, which if exceeded is indicative of device being tilted along positive (step 89) or negative (step 92) y axis. AMIN represents a minimum acceleration value, typically 300, associated with little or no tilt along x or z axis. MAXCMD represents the maximum value of COMMAND, such as 7000. MINCMD represents the minimum value of COMMAND, such as 300. DI is the amount COMMAND can change in one acceleration data sampling period, typically 50.

At step 95 to adjust to the new user desired stimulation level, the COMMAND variable is set to the U value, a 20 second timer, called Savetimer, is started, and PUCK flag is turned "off" for a 100 millisecond timed delay (as measured by the heartbeat timer) to stop driver 46 from actuating actuators 28. After the 100 millisecond delay expires, PUCK flag is turned "on" to again start driver 46 to actuate actuators 28. The 100 millisecond delay generates a brief shutter in the motion of platform 12, which provides the user notice (e.g., tactile feedback) of success in changing the stimulation level by the +/− step value DI as desired. In operation, the user holds device 10 tilted as desired for several seconds so that microcontroller 44 passes several times through FIG. 12C until platform 12 starts vibrating at the desired stimulation level. Although the 100 millisecond delay is preferred, other period of delay may be selected.

During this period of delay, optionally microcontroller 44 may send other signals along input 45*a* and 45*b* at a setting for Vref level at 45*c* which enables driver 46 to output an audio signal that allows actuators 28 to operate as typical speakers which the user can hear. Such audio signals may be stored in memory (e.g., non-volatile memory) of the microcontroller, such as a beep, tone indicating up or down, a synthesized voice informing the user of the value of the new stimulation level that is associated with the new COMMAND value, or other audible indicator of stimulation adjustment. Optionally one or more LEDs 49 (FIG. 10) are provided on circuit board 30 and visible below a transparent plastic window 14*c* (FIG. 4A) fixed in an opening along level portion 18 of platform 12 above circuit board 30. The microcontroller 44 may send signals to LEDs 49 to control their actuation in terms of color, number illuminated, intensity, and/or pattern indicating a representation of stimulation level associated with the current or updated value of the COMMAND variable, and/or the status of operation of the device, such as PUCK flag being "on" or "off". The optional visible display elements provided by such LEDs 49 may be located at another location on device 10, if desired.

If the value of U was outside the desired MAXCMD and MINCMD range (steps 91 or 94), or step 95 has been completed, a check is made at step 96 as to whether microcontroller 44 has received a tap signal from the accelerometer 50. As stated earlier, the accelerometer 50 can provide a signal at an input of microcontroller 44 when a tap has been received in the +/−y axis direction, such as by a user tapping upon device 10 with their foot on side walls 15*a* or 15*b*. If such tap signal is received at step 96 and device 10 is sitting flat at step 97 (i.e., FLAT flag is true), regardless of the whether Savetimer has expired or not, a check of drive status (i.e., the PUCK flag setting) is made at step 98. If PUCK flag is "on" indicating drive is on at step 98, then the value of the COMMAND variable currently stored in RAM of the microcontroller 44 is stored as the target COMMAND value in non-volatile memory and the PUCK flag is changed to "off" to turn off the drive of actuators 28. If PUCK flag is "off" indicating drive is off at step 98, then the COMMAND variable is set to the value of the stored target COMMAND value (or the default value if none stored) from non-volatile memory, and the PUCK flag is changed to "on" to turn on the drive of actuators 28. After steps 99 or 100, the microcontroller 44 returns to step 63 in FIG. 12A and continues from there as described above.

If in FIG. 12B the SYNC flag is true at step 86, then the process proceeds to step 101 of FIG. 12D. The microcontroller 44 stores in its RAM memory a history of at least the last N number of MAG sample calculated at step 75 for use in determining if there has been a change in platform 12 motion stimulation. For example N may equal three, providing MAGn0, MAGn1, and MAGn2, where MAGn0 is the current sample. In step 101 of FIG. 12D, a check is made whether the prior MAG value, MAGn1, is greater than the MAG value from two samples ago, MAGn2, and the current MAG sample, MAGn0. If not, the process proceeds to step 89 (FIG. 12C). If so, then at step 102 the SYNC flag is set to false, and proceeds to step 103. If the value of actual amplitude of acceleration of platform 12, AMPL, calculated at step 80 is greater than the current COMMAND value plus a tolerance value (e.g., 10), and DRIVE value is greater than the minimum allowable DRIVE value, MINDC, plus dDC (step 103), then DRIVE value is decreased by an amount dDC (step 104) and the process proceeds to step 89 (FIG. 12). Otherwise, a check is made whether AMPL value is less than the COMMAND plus a tolerance value (e.g., 10), and DRIVE value is greater than the maximum allowable DRIVE value, MAXDC, minus dDC (step 105). If so, the DRIVE value is increased by the amount dDC (step 106), otherwise the process proceeds to step 89 (FIG. 12). The value dDC is the amount of change in one adjustment cycle. The values of MINDC, MAXDC, dDC are stored for use by microcontroller 44 in its non-volatile memory of, and may for example be 300, 2277 and 5, respectively.

By repeating the above steps 101-106 periodically, a control loop is established which can increase or decrease the DRIVE value in one or more +/−dDC steps, which will cause subsequent AMPL values calculated at step 80 to approach the COMMAND value. The change in subsequent AMPL values is the result of the response of microcontroller 44 to each step change in DRIVE value to signals sent, via low pass filter 48, that establishes a Vref level at input 45*c* of driver 46, at the associated DRIVE value, and an increase or decrease in the current of the signal applied by driver 46 to actuators 28. The device 10 thus smoothly transitions as it automatically adjusts to change in load, mass or weight upon the platform 12 to the user desired stimulation level associated with the COMMAND value.

Returning to FIG. 12A, if no acceleration data has been received from accelerometer 50 by the microcontroller 44 at step 66, then at step 67 a check is made whether accelerometer 50 has sent a tap signal. If so, the drive is toggled on or off by toggling the PUCK flag state by microcontroller 44 (step 68). In other words, when a tap signal is received, the PUCK flag is changed from "on" to "off" if currently set to "on" and the microcontroller 44 as a result stops driving actuators 28 via signals to driver 46, or the PUCK flag is changed from "off" to "on" if currently sent to "off" to start driving actuators 28 via signals to driver 46, such as described earlier. Step 68 may be the same as described in steps 98-100 (FIG. 12C). If no tap from accelerometer 50 was received at step 67, a check is made as to whether or not the Savetimer is set at step 95 (started at step 95 each time a new COMMAND value is arrived at by detected user tilt of device 10) has expired (step 70). If so, then in FIG. 12E the current COMMAND value is stored as the new target COMMAND value in non-volatile memory (step 109) when the current COMMAND value is not equal to the COMMAND value last stored in non-volatile memory (step 108), otherwise microcontroller 44 continues to step 63 and continues from there as described above. Typically the user will tilt the device to make a desired number of + or − step tilt adjustments through steps 89-95 of FIG. 12C. Thus, not until 20 seconds has passed since the last update, does the microcontroller 44 change its non-volatile memory to the new target COMMAND value. If desired, other Savetimer delay period may be used.

If Savetimer was not reset since the last update of non-volatile memory, or if set at step 95 and not yet expired, the microcontroller 44 proceeds from step 70 to step 71. Microcontroller 44 at step 71 checks if one second has elapsed as measured by the microcontroller using the running heartbeat timer. If so, microcontroller 44 updates a use time counter in non-volatile memory of microcontroller 44 at step 72, and proceeds back to step 63 and continues from there as described above. If one second has not yet elapsed at step 71, microcontroller 44 returns back to step 63 and continues from there as described above.

Referring to FIG. 13, an example of external device 54 is shown in the case of a smartphone having a microprocessor operating a program, application, or software downloaded into memory of the smartphone which when run provides a user interface 112 on a touch screen display 110 enabling a user via keys and/or the display of the smartphone to interact and control device 10 operation. With device 10 in proximity for Bluetooth communication, the device 54 is operated by the user (or automatically if previously paired) to establish pairing connection with device 10, as per the manufacturer and software of the smartphone which is outside the scope of this invention. The user first sets the duration time of stimulation by selecting one of five durations 113 by pressing on one of five circles to the left of each duration setting. For example, 10, 20, 30, 45, or 60 minutes. The user sets the level of peak-to-peak stimulation of the device 10 by selecting, for example, one of five stimulation levels 114 by pressing on one of five circles to the left of the desired stimulation level setting. Once duration time and stimulation level is selected, the user presses on a Start button 115, and the duration time selected appear as timer 116, in hour, minutes, and seconds. Timer 116 represents a display of a countdown timer in memory of the smartphone. The user may later pause the device by pressing on the Pause button 117. Optionally, a Reconnect button 118 may be provided to re-establish Bluetooth connection if the device 10 fails to interact with the smartphone.

Using an established wireless connection between devices 10 and 54, device 54 sends a Puck "on" command to device 10 when Start button 115 is pressed, and Puck "off" command when either Pause button 117 is pressed, or when the countdown timer expires. The microcontroller 44 of device 10 receives such command and operates accordingly. Prior to sending the Puck "on" command, an Amplitude closed command is sent to device 10 with the Command value in terms of a COMMAND value for the selected stimulation level 114. The program operating the user interface in external device 54 stores Command values for each different stimulation level selectable by the user. For example, stimulation levels of 20 μm, 35 μm, 50 μm, 65 μm, 80 μm (in terms of + peak to − peak platform 12 motion displacement) correspond to Command values of 780, 1080, 1360, 1700, and 2010, respectively. The microcontroller 44 of device 10 stores the received Command value as a COMMAND value in its non-volatile memory, and sets the variable COMMAND to the received value. If the user changes to a different selected stimulation level during operation of device 10 (i.e., while timer 116 is running), another Amplitude closed command is sent with a Command value associated with such stimulation level. Although five stimulation levels and duration levels are shown, other numbers of stimulation levels and/or durations may be provided and selected by different graphical elements, such as a slide. In this manner, a user can remotely control operation of the device. The same or similar user interface may be provided by other types of external devices 54, such as a tablet or other microprocessor based device, which has a wireless transceiver that can communicate with a wireless transceiver in device 10.

When a remote such as provided by external device 54 is not present, or even when a connection has been established to external device 54, the user may adjust the stimulation level by tilting the device 10 until the desired stimulation level is reached, as described earlier in connection with FIG. 12C, and turn on or off the device 10 by tapping the device 10 as also described earlier.

Calibration of device 10 may be useful to account for variations and non-linearities in stimulation performance of over its range of levels. An external calibrated accelerometer may be attached to platform 12 to measure the amplitude of acceleration at one or more stimulation levels, and the COMMAND values for each level corrected, i.e., increased or decreased, to provide the desired measured amplitude of acceleration. In other words, as each stimulation level is associated with a different acceleration amplitude of platform motion 12, calibration of the device 10 can assure that COMMAND values used by external device 54 provide the desired different stimulation levels. As stated earlier, 50 μm stimulation level occurs at or about 0.2 g amplitude of acceleration of platform 12 by which the platform accelerates up to between its + and − peaks of displacement. The earlier example of COMMAND values for different stimulation levels represent COMMAND values corrected by such calibration for device 10 at time of manufacture. Once device 10 operation is so calibrated, different ones of device 10 may not require such calibration. However, if different ones of device 10 have different sets (or relationships) of calibrated COMMAND values for stimulation levels, then the set of COMMAND values for stimulation levels needed for a particular one of device 10 may be provided to external device 54 when downloading and storing the program, application, or software using an identifier, code, version, model, or number associated with that device 10 at the Internet server that provides such program, application, or software to the external device 54.

As circuit board 30 is described as being mounted to the underside of the platform 12 along surface 14*b*, all the components on the circuit board 30, such as accelerometer 50 and microcontroller 44, are thus attached to platform 12, and movable along with platform 12 when actuators 28 are operated. Less preferably, the circuit board 30 is mounted to base 13 with wires 28*a* to actuators 28.

From the foregoing description, it will be apparent that a device and method for applying stimulation to the foot or feet of a person has been provided. Variations and modifications of the herein described device and method (and software for enabling same), and other applications for the invention will undoubtedly suggest themselves to those skilled in the art. Accordingly, the foregoing description should be taken as illustrative and not in a limiting sense.

The invention claimed is:

1. A device for stimulation of a foot or feet of a user comprising:

a platform having an upper surface for placement of a bottom portion of at least one foot of a user;

one or more actuators attached to said platform under said upper surface for imparting motion to said platform;

a base disposed below said platform for supporting said device on an external surface, wherein said one or more actuators extending from said platform are not in contact with said base; and a plurality of motion guides which support said platform over said base and direct the motion of said platform to vary only in positive and negative vertical displacement with respect to said base responsive to operation of said one or more actuators to stimulate said at least one foot when present upon said upper surface, wherein at least part of said upper surface extends at an angle configured for supporting at said angle at least a front plantar portion of said at least one foot of the user when seated in front of said device, wherein said at least part of said upper surface that extends at said angle has an inward curvature configured to compress or conform the front plantar portion of said at least one foot that faces said part of said upper surface, wherein said device has a front and a back, said upper surface has a level portion, and a sloped portion which extends upward at said angle from said front of the device to said level portion which then extends to the back of the device, and wherein a height of the platform continuously increases from a front edge of the platform defining the lowest height along the inward curvature to the level portion.

2. The device according to claim 1 wherein said at least part of said upper surface is sloped upward at said angle from a front of the platform for supporting the front plantar portion of said at least one foot at said angle in which a back or heel portion of said at least one foot extends away from the device.

3. The device according to claim 1 wherein said device is operable in one mode in which said sloped portion is configured to support the front plantar portion of said at least one foot in which a back or heel portion of said at least one foot extends away from said front of the device and is disposed along said external surface.

4. The device according to claim 3 wherein said device is operable in another mode in which said level portion is configured to support the front plantar portion of said at least one foot and a back or heel portion of said at least one foot extends away from said back of the device at a raised height at or near a height of said level portion above said external surface.

5. The device according to claim 1 wherein said one or more actuators are each an inertial actuator.

6. The device according to claim 1 wherein said motion guides each comprise:

a guide member having an upper flange portion fixed to said platform and a downwardly extending portion that extends through an opening in said base; and a flexible joint member disposed along said extending portion between said upper flange portion and said base, in which said guide member motion varies up and down along said opening upon said flexible joint member responsive to operation of said one or more actuators.

7. The device according to claim 1 wherein the plurality of motion guides number four and are at different locations spaced from each other.

8. The device according to claim 1 further comprising a controller for controlling operation of said one or more actuators.

9. The device according to claim 8 wherein said controller is attached to said platform under said upper surface and moves with said platform responsive to operation of said one or more actuators.

10. The device according to claim 9 wherein said controller attachment to said platform is located along said platform spaced from said attachment of each of said one or more actuators to said platform.

11. The device according to claim 8 further comprising a driver for driving said one or more actuators to move said platform responsive to signals from said controller.

12. The device according to claim 8 further comprising a driver for driving said one or more actuators to move said platform responsive to signals from said controller for generating a sinusoidally varying amplitude of motion of the platform at a frequency.

13. The device according to claim 12 wherein said frequency is in a range of 10 Hz to 75 Hz.

14. The device according to claim 8 further comprising an accelerometer attached to said platform which provides acceleration data to said controller, and said controller uses said acceleration data to adjust power applied by said driver to said one or more actuators in accordance with a stimulation level selectable by the user.

15. The device according to claim 14 wherein said controller uses the accelerometer data to determine when the user has tilted the device indicating user selection to increase or decrease amplitude of motion of said platform until arriving at or near said stimulation level selected by the user.

16. The device according to claim 14 wherein said accelerometer provides a tap signal to said controller, and said controller operates responsive thereto to turn on or off motion imparted to said platform by said one or more actuators.

17. The device according to claim 14 wherein said controller is in wireless communication with an external device which provides the stimulation level selected by the user.

18. The device according to claim 1 wherein said at least one foot when present upon said upper surface receives said stimulation on skin or via one or more materials worn upon said at least one foot.

19. The device according to claim 1 wherein said upper surface is sized for supporting front plantar portions of both feet of the user when seated in front of the device in which at least heels of the feet of the user extend off the device.

20. The device according to claim 1 wherein said one or more actuators are each operative by imparting audio frequency signals into mechanical forces that impart motion to said platform.

21. The device according to claim 1 wherein each of said motion guides operate without any counterweight between said platform and said base that work towards decoupling said base from said motion of said platform.

22. A device for stimulation of a foot or feet of a user comprising:

a platform having an upper surface for placement of a bottom portion of at least one foot of a user;

one or more actuators attached to said platform under said upper surface for imparting motion to said platform;

a base disposed below said platform for supporting said device on an external surface, wherein said one or more actuators extending from said platform are not in contact with said base; and a plurality of motion guides which support said platform over said base and direct the motion of said platform to vary only in positive and negative vertical displacement with respect to said base responsive to operation of said one or more actuators to stimulate said at least one foot when present upon said upper surface, wherein at least part of said upper surface extends at an angle configured for supporting at said angle at least a front plantar portion of said at least one foot of the user when seated in front of said device; and wherein each of said motion guides further comprises:

a guide member having an upper flange portion fixed to said platform and a downwardly extending portion that extends through an opening in said base;

a flexible joint member disposed along said extending portion between said upper flange portion and said base, in which said guide member motion varies up and down along said opening upon said flexible joint member responsive to operation of said one or more actuators;

a retainer member which retains an end of said extending portion that extends through said opening, and another flexible joint member between said retainer member and said base.

23. A device for stimulating a foot or feet of a user comprising:

a platform having a surface in which at least part of said surface extends at an upward angle, wherein a front plantar portion of at least one said foot is positionable upon said part of said surface that extends at said angle, wherein said at least part of said surface that extends at said upward angle has an inward curvature upon which the front plantar portion of at least one said foot is positionable;

one or more actuators for applying motion to said platform; and a base disposed below said platform, in which said platform is limited to vary in up and down vertical motion with respect to said base responsive to operation of said one or more actuators, wherein said one or more actuators extend from said platform and are not in contact with said base, wherein said at least part of said surface of said platform at said upward angle continuously increasing in height from a front edge of the platform to a level to enable said at least one said foot to extend over said front edge of the platform with a heel portion of said at least one foot disposed away from said front edge of the platform when the front plantar portion of said at least one said foot is positioned upon said at least part of said surface which extends at said upward angle, and said front edge of the platform defines the lowest height of the platform along said inward curvature.

24. The device according to claim 23 further comprising:

a controller for controlling operation of said one or more actuators; and a driver operating responsive to signals from said controller for driving said one or more actuators to move said platform in a periodic amplitude varying motion.

25. The device according to claim 24 wherein said controller automatically adjusts power to said one or more actuators to maintain said periodic amplitude varying motion of said platform at or near a user selectable level in accordance with acceleration data received from an accelerometer attached to said platform.

26. The device according to claim 23 wherein said platform is spaced above said base by motion guides to facilitate said up and down vertical motion of said platform with respect to said base.

27. A system for stimulation of a foot or feet of a user comprising:

an upper member upon which at least part of at least one foot of a user is positionable, wherein at least part of said upper member extends at an upward angle with an inward curvature upon which the front plantar portion of said at least one said foot is positionable;

one or more actuators attached to said upper member that impart motion to said upper member;

a plurality of vertically disposed motion guides each having at least one flexible member, said upper member vibrates upon said motion guides with respect to a base in positive and negative vertical displacement responsive to operation of said one or more actuators, in which said one or more actuators are not in contact with said base; and each of said motion guides operate without any counterweight between said upper member and said base that work towards decoupling said base from vibration of said upper member, wherein said at least part of said upper member at said upward angle continuously increases in height from a front edge of the upper member to a level portion of said upper member, and said front edge of said upper member defines the lowest height of the upper member along said inward curvature.

* * * * *